US006669320B2

(12) United States Patent
Hayashi et al.

(10) Patent No.: US 6,669,320 B2
(45) Date of Patent: Dec. 30, 2003

(54) SERIAL RECORDING APPARATUS

(75) Inventors: Yoshinori Hayashi, Kyoto (JP); Kimiko Watanabe, Yamatoriyama (JP); Yoshikazu Kondoh, Izumiotsu (JP); Mikiya Okada, Nara (JP); Kenichi Ueda, Nara (JP); Yoshinori Nakahira, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/867,351

(22) Filed: May 29, 2001

(65) Prior Publication Data

US 2002/0001499 A1 Jan. 3, 2002

(30) Foreign Application Priority Data

Jun. 23, 2000 (JP) ..... 2000-190139

(51) Int. Cl.[7] ..... B41J 29/38; B41J 29/393
(52) U.S. Cl. ..... 347/16; 347/19
(58) Field of Search ..... 347/16, 105, 19, 347/14, 23, 12, 10, 15, 13, 11, 8, 104, 20; 400/279

(56) References Cited

U.S. PATENT DOCUMENTS 5,603,578 A 2/1997 Furuya ..... 400/279
5,798,773 A * 8/1998 Hiramatsu et al. ..... 347/19

FOREIGN PATENT DOCUMENTS

| | | | |
|---|---|---|---|
| JP | 05-147278 | 6/1993 | |
| JP | 406 031 932 | * 2/1994 | ..... B41J/2/175 |
| JP | 08-132679 | 5/1996 | |

* cited by examiner

*Primary Examiner*—Raquel Yvette Gordon
*Assistant Examiner*—Chales W. Stewart, Jr.
(74) *Attorney, Agent, or Firm*—Renner, Otto, Boisselle & Sklar

(57) ABSTRACT

A serial recording apparatus in accordance with the present invention appropriately selects ink nozzles of an ink head and prints on a sheet so that the amount of printing is substantially equal to an ordinary amount, when an inadequate amount of sheet feed occurs, and then, selects the ink nozzles of the ink head in accordance with how the inadequate amount of sheet feed is so as to carry out the next printing. This avoids that the inadequate sheet feedings are accumulated in the succeeding printings. Accordingly, even when a plurality of inadequate sheet feedings occur during the printings with respect to a single sheet, the inadequate sheet feedings are not accumulated, thereby avoiding that the quality of the printing deteriorates. Thus, it is possible to provide a serial recording apparatus which can resolve the inadequate printing by detecting the amount of sheet feed for each feeding, determining the print area in accordance with each amount of sheet feed, and carrying out the printing.

31 Claims, 17 Drawing Sheets

IMAGE PROCESSINGS OF READ-OUT DATA AND METHOD FOR TRANSMITTING OF PRINT DATA a: ALL AREAS OF INK NOZZLES
b: AREA OF NOZZLES TO BE USED DURING ORDINARY AMOUNT OF SHEET FEED
c: AREA OF NOZZLES TO BE USED DURING SHORTAGE OF AMOUNT OF SHEET FEED
d: AREA OF NOZZLES TO BE USED DURING EXCESS OF AMOUNT OF SHEET FEED

SERIAL RECORDING APPARATUS

FIELD OF THE INVENTION

The present invention relates to a serial recording apparatus that detects the amount of sheet feed each time the sheet is fed, determines a print area in accordance with each of the amount of sheet feed thus detected, and carries out the printing with respect to the print area thus determined so as to dissolve the inadequate printing.

BACKGROUND OF THE INVENTION

For example, Japanese unexamined patent publication No. 5-147278 (publication date: Jun. 15, 1993) discloses the relation between the amount of sheet feed and a print area in a conventional serial printer. Such a serial printer is provided with (a) means for setting the amount of sheet feed provided that the amount of sheet feed is fixed, and (b) means for controlling the amount of sheet feed. In this case, the print area is fixed so as to correspond to a single amount of sheet feed.

According to U.S. Pat. No. 5,603,578 (issue date: Feb. 18, 1997), proposed is a method in which the amount of sheet feed is fixed, zero is written in an area sticking out the sheet so as not to jet the ink.

According to Japanese unexamined patent publication No. 8-132679 (publication date: May 28, 1996), proposed is a method in which, prior to the printing, images are overlapped so that a white line does not appear in a main scanning direction.

However, according to each of the conventional arts advance steps are prepared and made so that the amount of sheet feed is kept to be uniform. Accordingly, no posterior steps are made with respect to the inevitable fact that the amount of sheet feed is not uniform.

Even in the advance above-mentioned steps, the following problems arise. More specifically, in the case where the amount of sheet feed changes due to the change in the feed load in the feeding system in accordance with the kinds of the sheet such as size, thickness, and smoothness, it is most likely that a white line appears in the joint portion of the images when the amount of sheet feed is too much. In contrast, the slipping off of the printing due to such as the occurrence of a double printing in the joint portion of the images when the amount of sheet feed is too little.

SUMMARY OF THE INVENTION

The present invention is made in view of the foregoing problems, and its object is to dissolve the inadequate printing by detecting the amount of sheet feed each time the sheet is fed, determining a print area in accordance with each of the amount of sheet feed thus detected, and carrying out the printing with respect to the print area thus determined.

In order to achieve the foregoing object, a serial recording apparatus in accordance with the present invention is provided with at least one recording means for jetting visualizing agent such as ink toward a recording medium such as a sheet via a plurality of jet sections such as nozzles, in which information corresponding to 1 line is recorded (printed) to the recording medium while the recording medium is fed and scanned in a first direction, and feed means such as a sheet feed roller and an idler roller feeds the recording medium in a second direction, is characterized by further comprising the following means.

More specifically, the serial recording apparatus further comprises (a) feed amount detection means such as encoder for detecting feed amount of the recording medium by the feed means in the second direction after each scanning finishes, and (b) jet section selecting means such as a computer for selecting jet sections to be used for recording among the plurality of jet sections in accordance with the feed amount that has been detected by the feed amount detection means.

According to the invention, the visualizing agent is jetted toward the recording medium via the jet sections, while at least one recording means are fed and scanned in the first direction, thereby resulting in that the information corresponding to 1 line is recorded. When the information corresponding to 1 line is recorded, the recording medium is fed by the feed means in the second direction. Then, the information corresponding to the next line is recorded in a similar manner to the above-mentioned procedure. By repeating the procedure, the information is continuously recorded on a single recording medium.

It may happen that the feed amount of the recording medium is not coincident with the target amount due to some reasons, during the feeding of the recording medium in the second direction so as to record in the next line the information corresponding to the next line. Namely, the feed amount of the recording medium may become more or less than the ordinary (usual) amount. In this case, according to the conventional art, since all the jet sections are used so as to jet the visualizing agent, although the recording should have been carried out continuously, a vacant area occurs in the recording result when the feed amount is more than the ordinary amount while an overlapping area is occurs in the recording result when the feed amount is less than the ordinary amount. This causes the problem that the quality of the recording remarkably deteriorates.

In order to solve the problem, according to the present invention, the feed amount of the recording medium in the second direction is detected, and based on the feed amount that has been thus detected, the jet sections to be used for recording the information corresponding to the next line are selected among the plurality of jet sections. Accordingly, only the jet sections that has been thus selected jet the visualizing agent toward the recording medium.

More specifically, after the scanning of 1 line is carried out, the recording medium is fed in the second direction by the feed means. Thereafter, the scanning of the next line is carried out. The feed amount is detected by the feed amount detection means. Based on the feed amount that has been thus detected, the jet sections to be used for the recording of the next line are selected among the plurality of jet sections by the jet section selecting means. This allows to continuously record the information on the recording medium, even when the feed amount becomes more or less than the ordinary amount, without the vacant area and/or the overlapping area in the recording result, by changing the selection of the jet sections in the recording means that contributes to the recording. Therefore, it is possible to avoid that the inadequate recording occurs.

For example, when the recording medium is fed by the ordinary feed amount in the second direction, it is assumed that the visualizing agent is jetted toward the recording medium via a predetermined number of jet sections so as to carry out the recording of the information. When the recording medium is fed more than the ordinary amount in the second direction, jet sections on the upstream side in the second direction are selected more than usual in accordance with the feed amount that has been detected. Such jet sections contribute to the recording, so that it is possible to continuously record the information with respect to the area that will be the vacant area according to the conventional art.

In contrast, when the recording medium is fed less than the ordinary amount in the second direction, (a) jet sections on the downstream side in the second direction are selected more than usual in accordance with the feed amount that has been detected and (b) jet sections on the upstream side in the second direction are selected less than usual in accordance with the feed amount that has been detected. Such jet sections contribute to the recording, so that it is possible to record the information with respect to the area that will be the overlapping area according to the conventional art.

The following arrangement is preferable. More specifically, the recording means is provided with (a) a first area (Y1) in which a plurality of jet sections are provided in the vicinity of an end part of the recording means on the upstream side in the second direction, (b) a second area (Y2) in which a plurality of jet sections are provided in the vicinity of an end part of the recording means on the downstream side in the second direction, (c) a third area (Z), other than the first and second areas, in which a plurality of jet sections are provided. The jet section selecting means (1) selects all the jet sections in the third area when the recording medium is fed by the ordinary feed amount in the second direction, (2) selects the jet sections among the first through third areas in accordance with the feed amount that has been detected, when the recording medium is fed more than the ordinary amount in the second direction, and (3) selects the jet sections among the second and third areas in accordance with the feed amount that has been detected, when the recording medium is fed less than the ordinary amount in the second direction.

In this case, when the recording medium is fed by the ordinary feed amount in the second direction, all the jet sections in the third area are selected by the jet section selecting means. The visualizing agent is jetted toward the recording medium via the jet the sections that have been thus selected so as to record the information on the recording medium.

In the case where the recording medium is fed more than the ordinary amount in the second direction, when the recording is carried out in a similar manner to the ordinary case, it is most likely to occur a vacant area in the recording result. In order to meet the deficiency, according to the present invention, the jet sections are selected among the first through third areas by the jet section selecting means in accordance with the feed amount that has been detected. This allows (a) the jet sections in the area which is larger than usual to be selected and (b) the visualizing agent to jet toward the recording medium via the jet sections that have been thus selected so as to record the information on the recording medium. Accordingly, it is possible to continuously record the information with respect to the area that will be the vacant area according to the conventional art.

In the case where the recording medium is fed less than the ordinary amount in the second direction, when the recording is carried out in a similar manner to the ordinary case, it is most likely to occur an overlapping area in the recording result. In order to meet the deficiency, according to the present invention, the jet sections are selected among the second and third areas by the jet section selecting means in accordance with the feed amount that has been detected. In this case, when jet sections on the upstream side of the third area in the second direction are not selected in accordance with the required number, the jet sections that have not been thus selected do not contribute to the recording. The visualizing agent is jetted toward the recording medium via the jet sections that have been selected so as to record the information, so that it is possible to continuously record the information with respect to the area that will be the overlapping area according to the conventional art.

Some feed amount allows to record the information with the same recording width (the width in the second direction) as the ordinary recording, by selecting the jet sections in the areas other than the area of the ordinary recording.

It is preferable that the jet section selecting means is arranged so that when the recording medium is fed more than the ordinary amount in the second direction, the number of the jet sections selected in the second area is increased in accordance with the excess of feed amount and the jet sections selected in the areas other than the second area are fixed (not changed, i.e., the same jet sections as those of the ordinary printing are selected). In contrast, when the recording medium is fed less than the ordinary amount in the second direction, the number of the jet sections selected in the third area is reduced in accordance with the shortage of feed amount and the jet sections selected in the areas other than the third area are fixed (not changed, i.e., the same jet sections as those of the ordinary printing are selected).

With the arrangement, since the number of the jet sections selected in the second area is increased in accordance with the excess of feed amount and the jet sections selected in the areas other than the second area are fixed, when the recording medium is fed more than the ordinary amount in the second direction, it is possible to carry out the recording in the next line with the same recording width (in the second direction) as the ordinary one the width.

Similarly, since the number of the jet sections selected in the third area is reduced in accordance with the shortage of feed amount and the jet sections selected in the areas other than the third area are fixed, when the recording medium is fed less than the ordinary amount in the second direction, it is possible to carry out the recording in the next line with the same recording width (the width in the second direction) as the ordinary one.

Namely, it is ensurely possible to avoid the inadequate recording without damaging the quality of the recording even when it continuously occurs that the feed amount is more or less than usual.

It is preferable that the number of the jet sections in each of the first and second areas is 10 percent of that in the third area.

With the arrangement, each of the first and second areas has the jet sections whose number is 10 percent of that in the third area. Upon completion of the recording in 1 line, the recording medium is fed in the second direction, and then stops so as to record the information based on a stopping instruction. Note that it takes a little for the recording medium to stop since such a stopping instruction is entered. More specifically, the recording medium stops after the recording medium is fed in accordance with the inertia. The feed amount of the recording medium in the second direction due to the inertia is about 10 percent of the number of the jet sections in the third area. The jet sections in the first and second are selected in the foregoing manner, taking the inertia into consideration. Thus, the number of the jet sections in the first and second areas is limited, thereby enabling to reduce the cost and to simplify the structure of the apparatus as a whole because it is not necessary to provide any excessive jet sections.

It is preferable that the feed means is composed of a feed roller and its idler roller, and the feed amount detection means detects the feed amount in accordance with the amount of revolution of the feed roller or the idler roller.

In this case, when the feed roller and its idler roller rotate, the recording medium is fed in the second direction in accordance with the revolution of the rollers. The feed amount detection means detects the feed amount of the recording medium in the second direction in accordance with the amount of revolution of the feed roller or the idler roller. The feed amount of the recording medium in the second direction is found based on the circumference length of the feed roller or the idler roller.

It is preferable that the feed means is composed of pairs of a feed roller and its idler roller, (a) a first pair of feed roller and its idler roller are provided in the vicinity of the recording medium and on the downstream side in the second direction and (b) a second pair of feed roller and its idler roller are provided in the vicinity of the recording medium and on the upstream side in the second direction, respectively, and the respective feed amount are detected by the feed amount detection means in accordance with the revolution of the feed roller or the idler roller of each pair.

In this case, the feed amount of the recording medium in the second direction is found by the calculations. During the feeding, the unevenness of the feeding force may occur due to how the recording medium is caught by the feed rollers and their idler rollers, thereby causing the bending of the recording medium.

In order to meet the deficiency, according to the present invention, in the respective first and second pairs that are provided in the vicinity of the recording medium and on the downstream and upstream sides in the second direction, the respective feed amount are detected in accordance with the revolution of the feed roller or the idler roller of each pair. This allows to detect that the unevenness of the feeding force have occurred. It is possible to detect the feed amount with higher accuracy based on the detected result.

It is preferable that, during the recording of the information corresponding to 1 line, a mark for detecting the feed amount is recorded in a non-record area of the recording medium, and the feed amount detection means detects the feed amount in the second direction based on the mark that has been recorded.

In this case, the feed amount of the recording medium is detected by the feed amount detection means based on the mark that has been recorded in the non-record area. This allows to detect the feed amount of the recording medium without affecting the recorded information in the record area and without any complicated structure. It is preferable that the recording of the mark is carried out with the use of a visualizing agent having a hue that is hard to be recognized. The recording of the mark may be made by the dot recording or the line recording. From a viewpoint of the quality of the recording, the dot recording is more preferable because the dot recording less damages the viewer's feeling and gives no ugly feeling to the viewer's.

It is preferable that the mark that has been recorded is detected by detection means provided on the more upstream side than the recording medium in the second direction. This allows to quickly cope with the recording operation in the next line.

It is preferable that the feed amount detection means is provided with (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

In this case, the idler roller rotates in accordance with the feed amount of the recording medium. In response thereto, the encoder rotates. The light from the light emitting section is emitted toward the encoder. When the light from the light emitting section is directed toward the slit, the light thus directed goes through the slit and arrives at the light receiving section. In contrast, when the light from the light emitting section is directed toward a part between the slits, the light thus directed is blocked and can not arrive at the light receiving section. This allows the light receiving section to generate pulse signals that vary depending on the revolution of the idler roller. The number of revolution of the idler roller can be detected by counting the pulse number of the pulse signal. Since the circumference length of the idler roller is known, the feed amount of the recording medium that has been fed can be converted (found) based on the number of revolution that has been thus detected.

It is preferable that the jet section selecting means is provided with (1) a first memory means for storing image information that has been read out from an original document, (2) a second memory means for storing record information that is a resultant of an image processing with respect to the image information that has been stored in the first memory means, and (3) a third memory means for storing a resultant, to be sent to the recording means, of removing the record information for maintaining a continuity between information that has been read out previously and information that will be read out next from the record information that has been recorded in the second memory means. The jet section selecting means (a) selects the jet sections in the third area so as to carry out an ordinary amount of recording when the feed amount of the recording medium is ordinary, (b) selects the jet sections in an area bridging between the second and third areas so as to carry out an ordinary amount of recording, then stores image information that has been read out from a broader area of the original document in the first through third memory means and selects all the jet sections in the third area and one part of the jet sections in the second area in accordance with the information that has been recorded in the third memory means for the recording of the recording means, when the feed amount of the recording medium is more than usual, and (c) selects the jet sections in an area bridging between the first and third areas so as to carry out an ordinary amount of recording, then stores information that has been read out from a narrower area of the original document in the first through third memory means and selects the jet sections on the first area side in the third area in accordance with the information that has been recorded in the third memory means for the recording of the recording means, when the feed amount of the recording medium is less than usual.

In this case, the original document is read out and the resultant image information is stored in the first memory means. The image information that has been stored in the first memory means is transmitted to the second memory means. The image information thus transmitted is subjected to the image processing, and the resultant of the image processing is stored as record information in the second memory means. The resultant of removing, the record information for maintaining the continuity between information that has been read out previously and information that will be read out next, from the record information that has been stored in the second memory means is stored in the third memory means. The information that has been stored in the third memory means is recorded on the recording medium via the recording means. Thus, the record information for maintaining the continuity between information that has been read out previously and information that will be read out next is remained in the second memory means, thereby ensuring to maintain the continuity of the information to be recorded on the recording medium.

When the feed amount of the recording medium is ordinary, all the jet sections in the third area are selected, the information that has been stored in the third memory means is transmitted to the recording means, and the ordinary amount of recording is carried out via the jet sections thus selected.

When the feed amount of the recording medium is more than usual, the jet sections in an area bridging between the second and third areas are selected so as to carry out the ordinary amount of recording. Then, the image information is read out from a broader area of the original document, and is stored in the first through third memory means in their respective forms. This causes the first through third memory means to have more amount of information than usual stored. All the jet sections in the third area and one part of the jet sections in the second area are selected in accordance with the information that has been recorded in the third memory means so that the recording means carry out the recording. This allows that all the jet sections in the third area are selected so as to carry out the next recording in an ordinary manner. Accordingly, it can be avoided that the excess of the feed amount is not accumulated in the succeeding recordings.

When the feed amount of the recording medium is less than usual, the jet sections in an area bridging between the first and third areas are selected so as to carry out the ordinary amount of recording. Then, the image information is read out from a narrower area of the original document, and is stored in the first through third memory means in their respective forms. This causes the first through third memory means to have less amount of information than usual stored. The jet sections on the first area side in the third area in accordance with the information that has been recorded are selected in the third memory means so that the recording means carry out the recording. This allows that all the jet sections in the third area are selected so as to carry out the next recording in an ordinary manner. Accordingly, it can be avoided that the shortage of the feed amount is accumulated in the succeeding recordings.

As is clear from the foregoing description, even when the recording medium is fed more or less than usual, the continuity of the image information is maintained, the defect and overlapping of the image information do not occur, and it is possible to provide an apparatus with compact and low cost. Further, even when inadequate sheet feedings occur during the recording of a single recording medium, the inadequate sheet feedings are not accumulated, thereby ensuring to remarkably improve the quality of the recording.

The first through third memory means having a small recording capacity are used in considerations of factors such as (a) the size and cost of the apparatus and (b) the fact that the serial recording causes not to cover the large record area by a single scanning. According to the present invention, as has been described above, it is possible to effectively use such memory means having a small recording capacity.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

DESCRIPTION OF THE EMBODIMENTS

The following description deals with one embodiment of the present invention with reference to FIGS. 1 through 17.

The following description deals with the case where an ink jet type recording apparatus (hereinbelow referred to as an ink jet printer) is exemplified as an example of a serial recording apparatus in accordance with the present embodiment. Note that the present invention is not limited to the ink jet printer as is clear from the following description.

Figure 5:
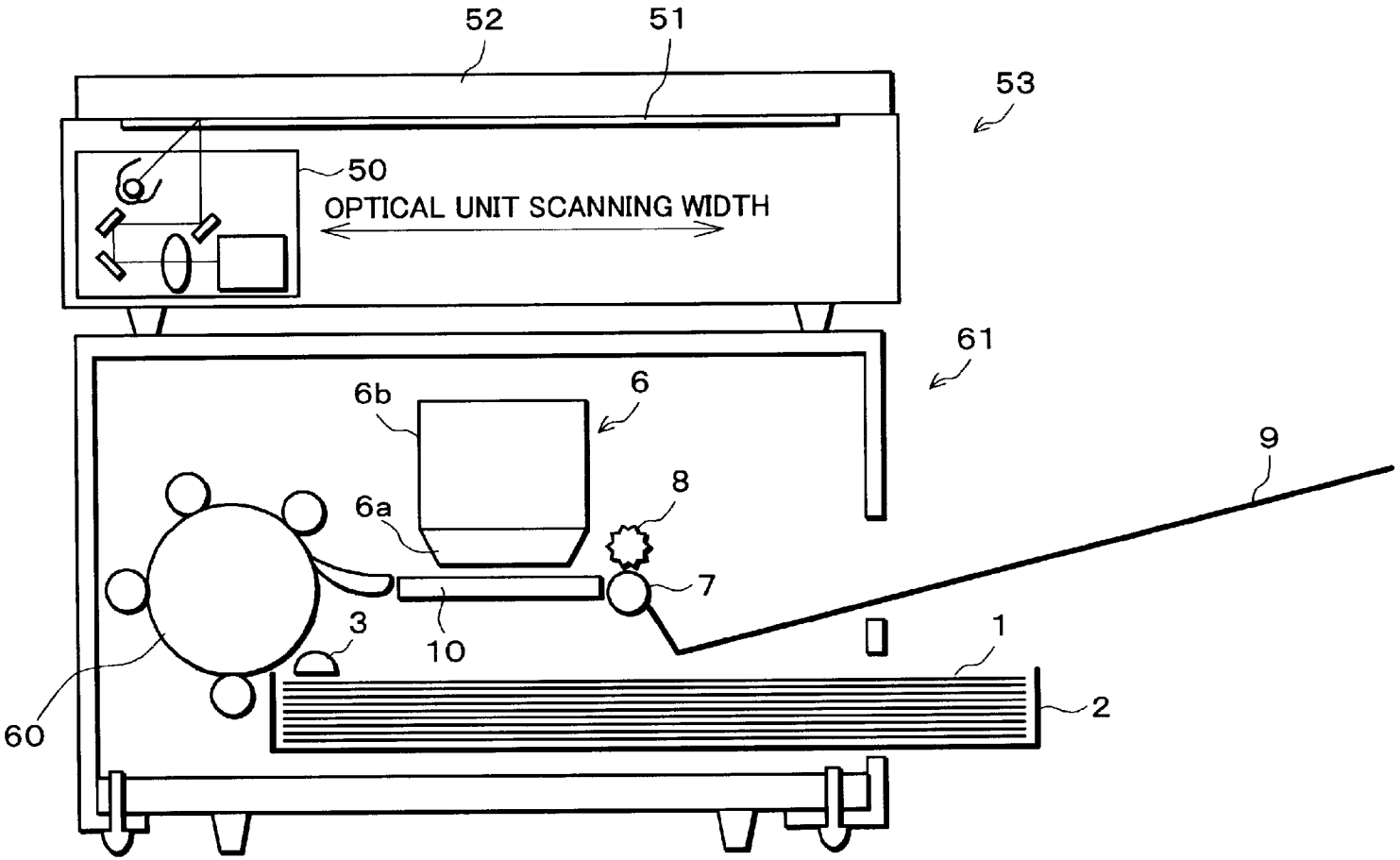
FIG. 5 is an explanatory diagrams showing an ink jet printer, having a scanner, that is one example of a serial printer in accordance with the present invention.

FIG. 5 shows an example of the structure of an ink jet printer having a scanner. The ink jet printer is mechanically divided into an original document read-out unit 53 and a print unit 61. The original document readout unit 53 is provided with an optical unit 50 which scans the original document on a platen glass 51 within an optical unit scanning width so as to read out image information of the original document. A control section of the ink jet printer is provided with first through third memories (not shown). The first memory stores the image information that has been read out by the optical unit 50. The second memory stores print information. The print information is obtained as follows: the image information, that has been stored by the first memory, has been subjected to image processing so as to obtain the print information. The third memory stores the print information to be transmitted to an ink head 6*a*.

Memories having a small recording capacity are used as the respective first through third memories in considerations of factors such as (a) the size and cost of the apparatus and (b) the fact that the serial printing causes the ink head 6*a* not to cover the large print area by a single scanning. In order to effectively use the memories having such a small recording capacity, the read-out is carried out with respect to such memories having a small recording capacity in a manner so that the original document area (the sub-scanning direction) is divided into a plurality of areas. The number of such divisions changes a little depending on (a) the amount of image information in the original document (corresponding to the change in the recording capacity due to the image compression in the memory) and (b) the area in which a single scanning allows the ink head 6*a* to print.

According to the ink jet printer, the print unit 61 allows that a sheet 1 on a feed cassette 2 is fed onto a platen 10 by a pickup roller 3 via a sheet feed roller 60. An ink carriage 6 is provided so as to be opposite to (face to face each other) the platen 10. The ink carriage 6 is composed of the ink head 6*a* (recording means, printing means) and an ink tank 6*b*. After the printing is carried out with respect to the sheet 1, the sheet 1 is discharged to a discharge tray 9 by the star roller 8 and the discharge roller 7. The ink head 6*a* is scanned in a direction orthogonal to a sheet feed direction during the printing.

Figure 6:
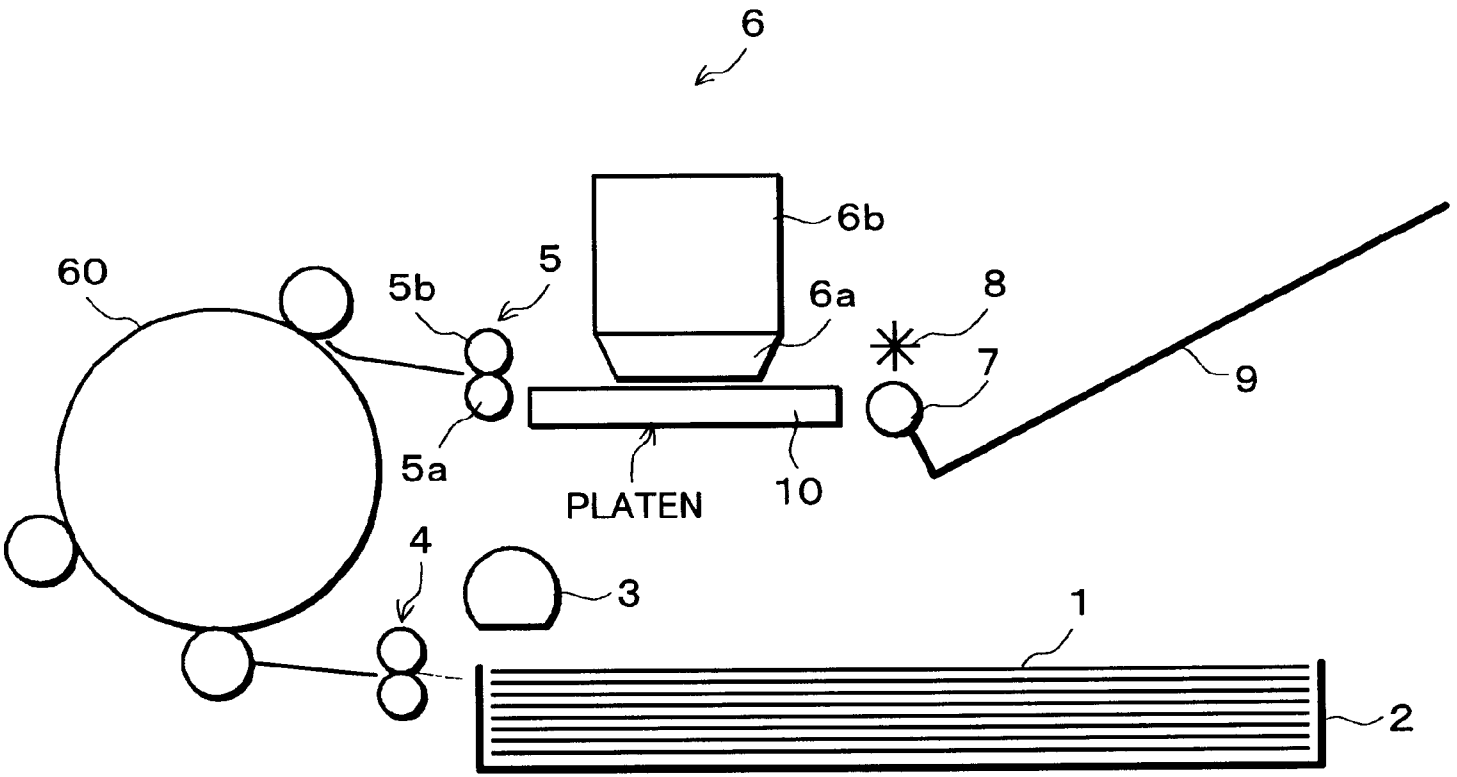
FIG. 6 is an explanatory diagrams showing, as an example, how the printing operation is carried out in the ink jet printer.

The following description deals with how the printing is carried out in a recording apparatus using a recording head of ink jet type with reference to FIG. 6.

As shown in FIG. 6, a plurality of sheets 1 are stacked on a feed tray (not shown) in the feed cassette 2. Upon receipt of a printing request (recording request) based on the image information from a device such as a computer (not shown), the top sheet 1 is fed by the pickup roller 3 for the feeding. The sheet 1 thus fed by the pickup roller 3 is further fed to PS rollers 5 (paper stop rollers or resist roller) by feed rollers 4 via a sheet feed path in accordance with the image information. The PS rollers 5 are provided for adjusting so that the head end of the image information is coincident with the head end of the sheet.

The PS rollers 5 function as idler rollers ensuring a printing timing, i.e., ensuring that the head end of the image information is coincident with the head end of the sheet 1. Then, the sheet 1 arrives at a printing section including the platen 10 via the PS rollers 5. The PS rollers 5 are constituted by a pair of PS roller 5*a* and its idler roller 5*b* that carries out the idler operation in accordance with the feed speed. This allows to stabilize the feeding of the sheet 1 and to avoid that the printing quality deteriorates.

The printing section is composed of an ink carriage 6 and a shaft (not shown) for holding the ink carriage. The ink carriage 6 is provided with the ink head 6*a* and the ink tank 6*b*. The shaft is provided for smoothing the scanning of the ink carriage 6. The ink (visualizing agent) is supplied to the ink head 6*a* from the ink tank 6*b* in accordance with the image information. This allows the ink to jet toward the sheet 1 so as to be recorded on the sheet 1 via a plurality of ink nozzles (jet section) 20 (see FIG. 10) of the ink head 6*a*.

During the recording, the sheet 1 temporarily stops until the ink carriage 6 finishes the scanning with respect to a single line (the scanning in the first direction). Thereafter, the sheet 1 is fed again by the feed amount corresponding to the plural ink nozzles 20 of the ink head 6*a*. This processing is consecutively carried out in the printing section in accordance with the image information. This allows that the image information is recorded on the sheet 1 by means of the ink.

The sheet 1 thus recorded is discharged to the discharge tray 9 via the discharge roller 7 and the star roller 8 for a user's possession. Note that the reason why the star roller 8 is used is that the ink which has been jetted has no quick drying property. Namely, it takes 30 seconds to 50 seconds for the ink to dry out.

Figure 7A:
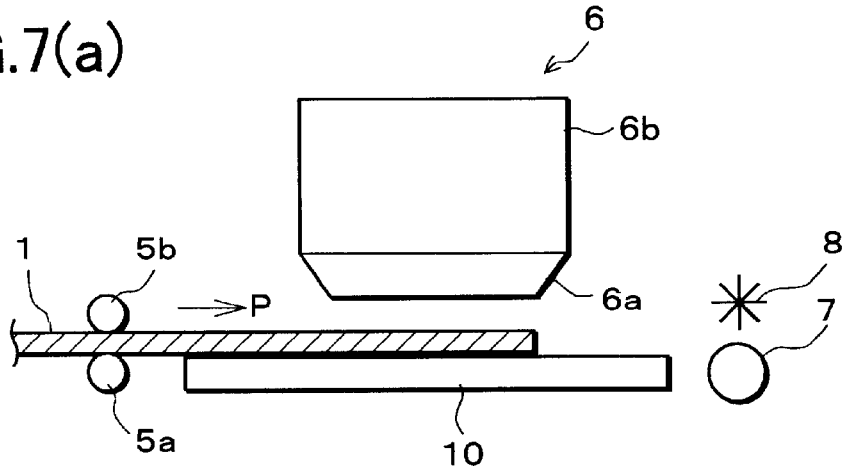
FIGS. 7(*a*) through 7(*c*) are explanatory diagrams showing how the feed speed changes depending on the kinds of the sheet such as material, size, and thickness, FIG. 7(*a*) shows the state in which the sheet is held only by PS rollers, FIG. 7(*b*) shows the state in which the sheet is held by the PS rollers and a discharge roller, FIG. 7(*c*) shows the state in which the sheet is held by the discharge roller and a star roller.
Figure 7B:
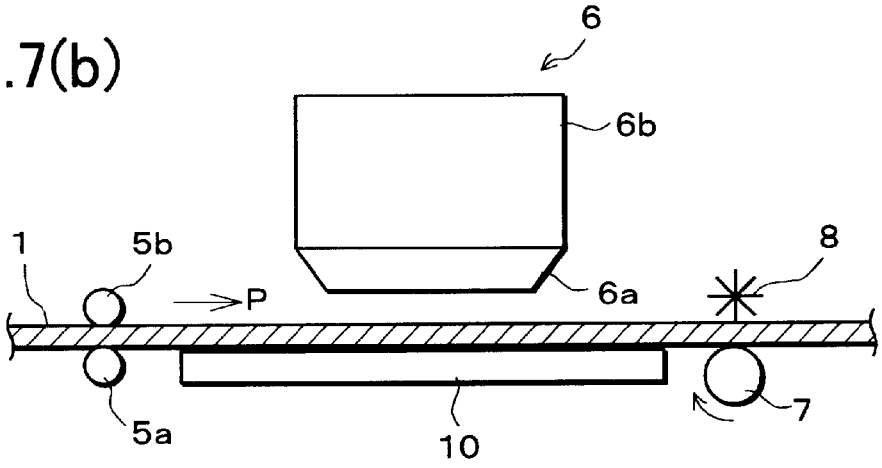
Figure 7C:
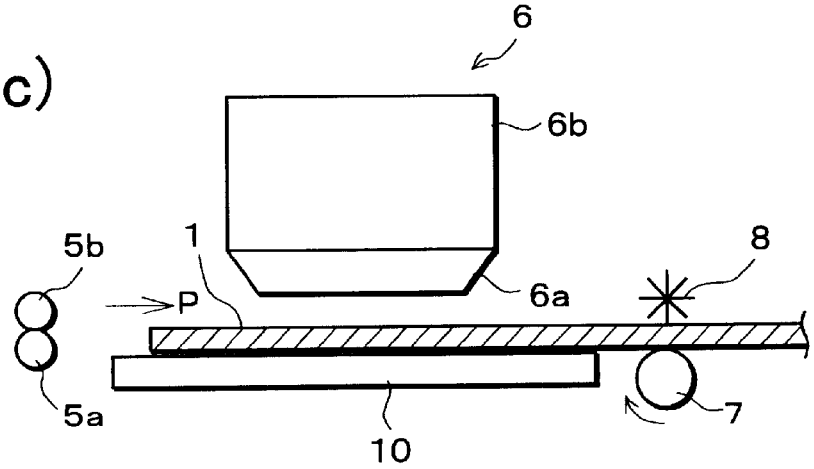

The following description deals with the ink jet printer of the present invention with reference to FIG. 7.

FIG. 7 is an explanatory diagrams showing how the feed speed changes depending on the kinds of the sheet such as material, size, and thickness. As is clear from FIGS. 7(*a*) through 7(*c*), the sheet feed states are classified by 3 (three)

types. More specifically, FIG. 7(*a*) shows the state in which the sheet 1 is held (caught) only by the PS rollers 5 so that the sheet 1 is driven and fed only by the PS rollers 5. FIG. 7(*b*) shows the state in which the sheet 1 is held by the PS rollers 5 and the discharge roller 7 so that the sheet 1 is driven and fed by the PS rollers 5 and the discharge roller 7. FIG. 7(*c*) shows the state in which the sheet 1 is held by the discharge roller 7 and the star roller 8 so that the sheet 1 is driven and fed by the discharge roller 7.

The feed speed of the sheet 1 varies depending on how the sheet 1 is held as shown in FIGS. 7(*a*) through 7(*c*), thereby causing the amount of sheet feed to change. The reason thereof is that the peripheral speed of the roller on the discharge side (discharge roller 7) is set to be faster a little than that of the roller on the feed side (PS roller 5*a*) so that the sheet 1 does not slacken (the sheet 1 does not float). Note that the sheet 1 slips or slackens when the relation between the rotation speeds of the two rollers is reverse to the foregoing relation or when the rotation speeds of the two rollers are coincident with each other.

According to the present embodiment, the rotation speeds of the two rollers are set so as to satisfy the equation: (peripheral speed of PS roller 5*a*): (peripheral speed of discharge roller 7)=1:1.01 to 1:1.02. The slackening of the sheet 1 causes the sheet 1 to get in touch with the ink head 6*a*. As a result, the static electricity is accumulated in the ink head 6*a* so as to break the ink head 6*a*, or the positions at which the flying ink particles arrive change during the printing (recording) so that the printing quality (recording quality) deteriorates.

Figure 8A:
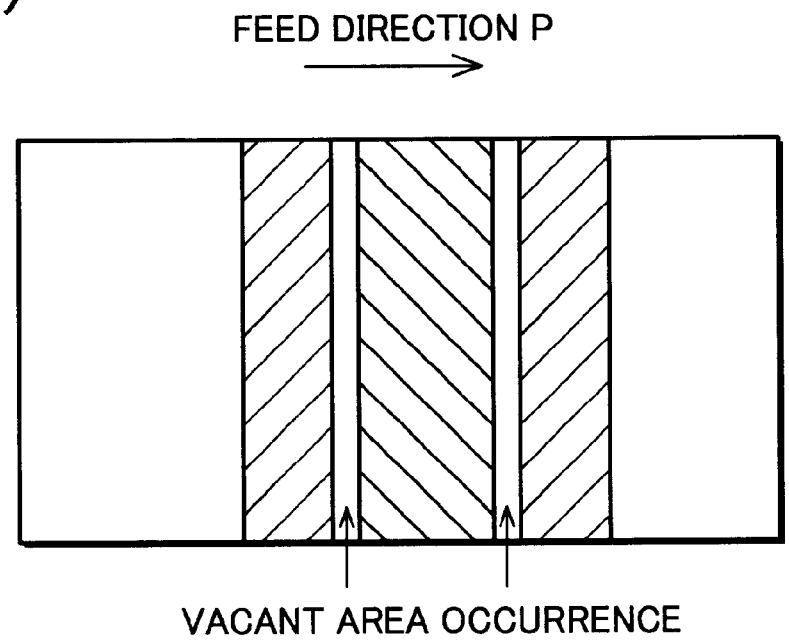
FIGS. 8(*a*) and 8(*b*) are explanatory diagrams showing that the vacant area occurs in the printed result when the amount of sheet feed is large, and the overlapping portion occurs in the printed result when the amount of sheet feed is little (i.e., in this case, another image is printed with respect to the area to which the previous image has already been printed or a single image is doubly printed with respect to a single print area.
Figure 8B:
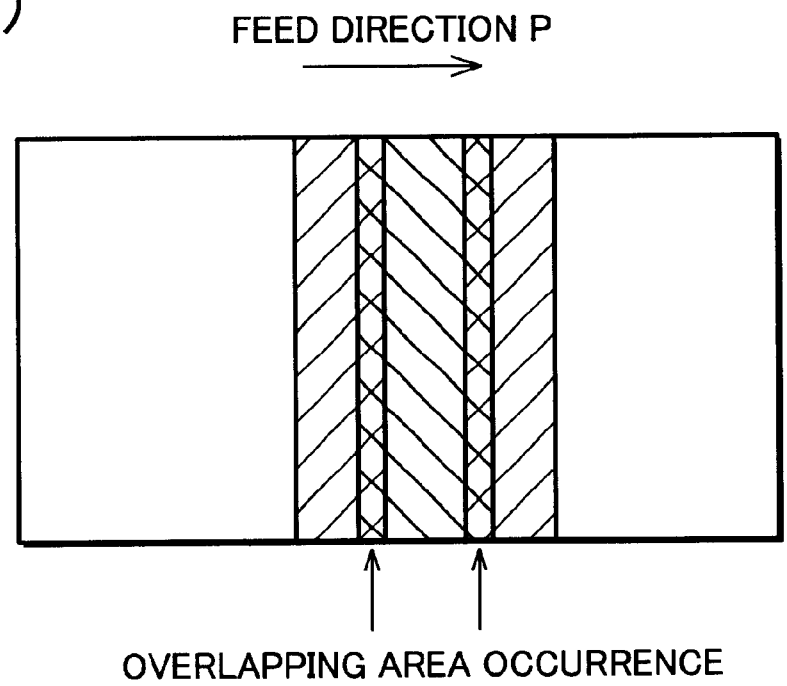

It is clear, in the arrangement wherein the feed speeds of the rollers 7 and 5*a* are a little different from each other so as to avoid that the sheet 1 slackens, that the load applied to the sheet varies depending on the feed state and the amount of sheet feed is not uniform. In this case, under the assumption that the print area is constant, a vacant area occurs in the printed result as shown in FIG. 8(*a*) when the feed amount of the sheet 1 is too much, while the overlapping area occurs in the printed result as shown in FIG. 8(*b*) when the feed amount of the sheet 1 is too little. The overlapping printing means that another image is printed with respect to the area to which the previous image has already been printed or a single image is doubly printed with respect to a single print area. Anyhow, the quality of the printing greatly deteriorates.

Figure 9A:
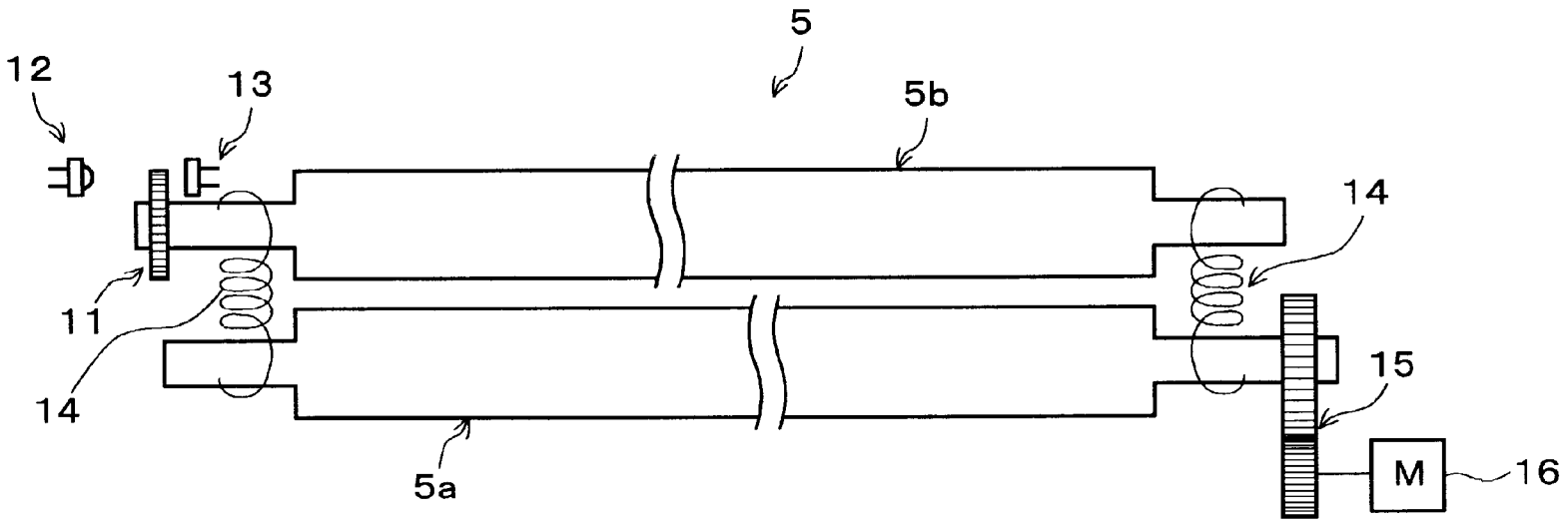
FIGS. 9(*a*) and 9(*b*) are explanatory diagrams showing one example of feed amount detection means of the present invention, FIG. 9(*a*) shows how the feed amount detection means is provided, and FIG. 9(*b*) shows a concrete structure of the feed amount detection means.
Figure 9B:
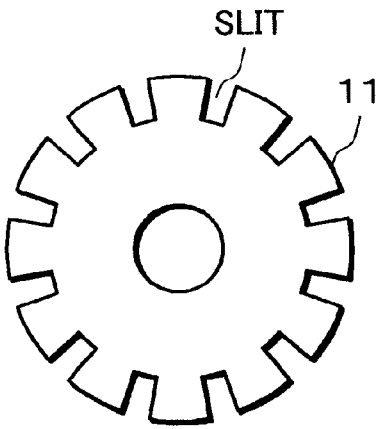

In order to solve the foregoing problems, according to the present invention, the detection of the amount of sheet feed is made, as shown in FIGS. 9(*a*) and 9(*b*), for example, in the vicinity of the ink head 6*a* by calculating the amount of revolution of the idler roller 5*b*. More specifically, provided are (a) an encoder 11 (feed amount detection means) that is provided in the vicinity of one end (for example, in FIG. 9(*a*), in the vicinity of the left end) of idler roller 5*b*-PS roller 5*a* pair on the downstream side of the sheet feeding path in a feed direction of the sheet 1, and (b) a sensor that measures the amount of revolution of the encoder 11. The sensor is composed of a light emitting section 12 (light emitting section) and a light receiving section 13 (light receiving section), and functions as the feed amount detection means. The amount of sheet feed is found (converted) based on the amount of revolution thus calculated and the peripheral length of the idler roller 5*b*.

The encoder 11, as shown in FIG. 9(*b*), is made of disk whose peripheral part is partially cut out so that slits are provided at even intervals. In the center of the encoder 11 provided is a hole through which the idler roller 5*b* is fitted. Thus, the encoder 11 rotates in the same direction in synchronization with the revolution of the idler roller 5*b*. There are provided with a light emitting section 12 and a light receiving section 13 so as to be opposite to each other via the encoder 11. The following operations are carried out in response to the revolution of the encoder 11. More specifically, when the light emitting section 12 and the light receiving section 13 are opposite to each other via the slit, the light emitted from the light emitting section 12 is directed to the light receiving section 13. In contrast, when the light emitting section 12 and the light receiving section 13 are opposite via a part between the slits, the light emitted from the light emitting section 12 can not arrive at the light receiving section 13.

Thus, the light receiving section 13 generates a pulse signal that varies depending on the revolution of the idler roller 5*b*. The number of revolution of the idler roller 5*b* can be detected by counting the number of the pulses of the pulse signal. Since the peripheral length of the idler roller 5*b* is known, the feed amount of the sheet 1 that has been fed between the two rollers is found based on the number of revolution thus detected.

Note that, in FIG. 9(*a*), the PS roller 5*a* is provided, at its right end section, with a gear 15 around a shaft. The revolution of a motor 16 is transmitted to the PS roller 5*a* via the gear 15. In response to the revolution of the PS roller 5*a*, the idler roller 5*b*, that is pressed via springs 14, rotates so that the sheet 1 is fed through between the two rollers.

The foregoing description deals with the case where the amount of sheet feed is detected by the PS rollers 5. However, there is a case where it is necessary to detect the amount of sheet feed by the PS rollers and the discharge roller 7 because the sheet feed speed varies according to FIGS. 7(*a*) through 7(*c*). It is prefer to provide the structure for detecting the amount of sheet feed before and behind the ink head 6*a*. The reason thereof is clear from the above description concerning the slackening phenomenon of the sheet.

It is also possible to detect the amount of sheet feed as follows. More specifically, the recording (printing) is carried out with respect to a non-image area (non-recording area) with the ink having a light hue such as a yellow (i.e., the marking is carried out with the yellow ink) during the scanning of the ink head 6*a*. When the sheet 1 is fed, the light hue thus recorded (printed) is detected by a sensor (not shown) that is provided in the vicinity of the ink head 6*a* for detecting such a light hue, thereby ensuring to detect the amount of sheet feed. In this case, when the ink having an ordinary hue is used instead of the light hue, such a hue is stood out in the sheet, thereby causing that the quality of the printing deteriorates. The printing with respect to the non-image area may be a dot printing or a line printing. The dot printing is prefer in view of the quality of printing. This is because the dot printing less damages the viewer's feeling.

The following description deals in detail with the printing operation that is carried out when the feed amount of the sheet 1 is detected and specified, with reference to FIG. 10, and FIGS. 1 through 3.

Figure 10:
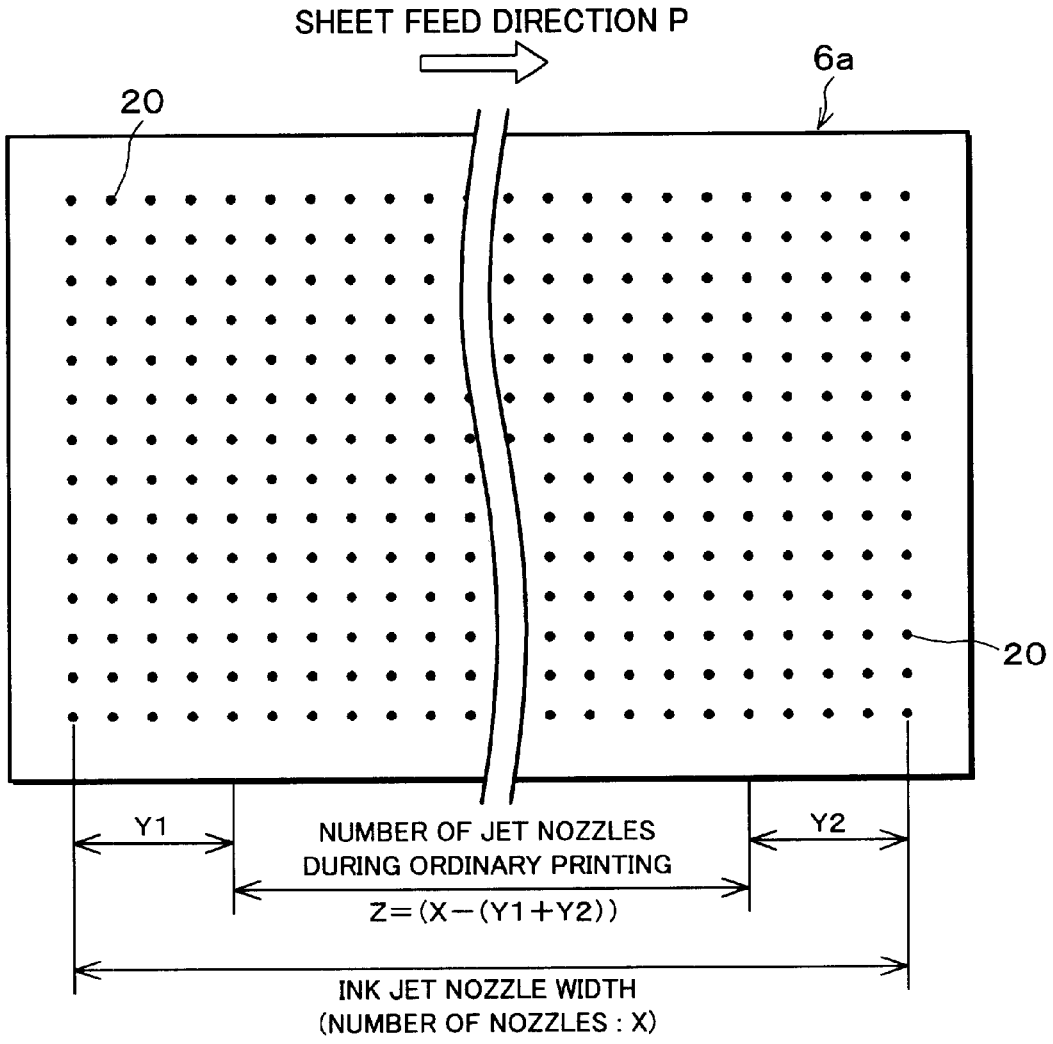
FIG. 10 is an explanatory diagram showing how the ink head is arranged.
Figure 11:
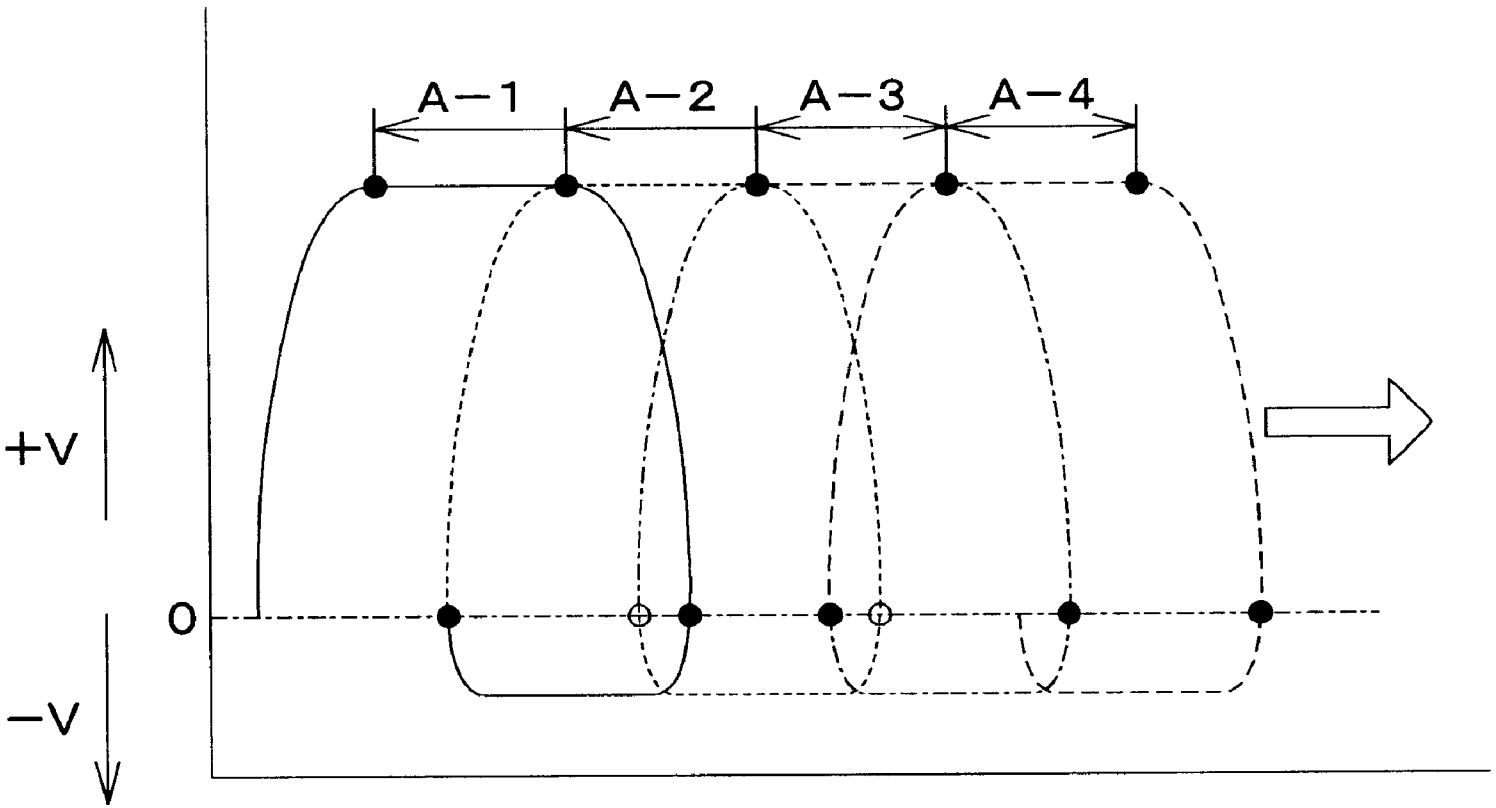
FIG. 11 is an explanatory diagram showing how the original document is read out in a divided manner in which the original document area (sub-scanning direction) is plurally divided.

FIG. 10 shows the arrangement of the ink head 6*a* that is used in the present invention. FIG. 10 is an explanatory diagram showing ink nozzles 20 provided on the surface of the ink head 6*a* that is opposite to the sheet 1. Note that the sheet feed direction is in a direction P directing to the right from the left in FIG. 10, and the sheet 1 is fed in the direction P.

When the first printing is carried out by using all the ink nozzles 20 of the ink head 6*a* that exist within an ink jet nozzle width (it is assumed that the total number of the ink nozzles 20 is indicated as "X"), the inadequate printing occurs when the amount of sheet feed becomes more or less than the ordinary amount of sheet feed as described earlier.

In view of the problem, according to the present invention, the range of the ink nozzles to be used are dispersed in first through third areas. The third area (the number of ink nozzles is Z) is the nozzle area that is used for the ordinary (normal) printing. The first area (the number of ink nozzles is Y1) is the nozzle area that is used when the amount of sheet feed is less than the ordinary amount. The second area (the number of ink nozzles is Y2) is the nozzle area that is used when the amount of sheet feed is more than the ordinary amount.

Note that the foregoing description deals with the case having three areas, for convenience sake, however, the present invention is not limited to this, i.e., the present invention includes a case where nozzle areas of more than three are provided in a divided manner.

The first and second areas are determined based on an operation distance (moving distance) due to the inertia, that will be described later, although the determination depends on the driving source (the driving source is the motor 16 in the case of FIG. 9). During the period between a period when a stop signal is inputted to the driving source and a period when the driving source actually stops, the driving source keeps operating based on the inertia which causes the sheet to move in the sheet feed direction. Accordingly, it is essential that each setting of the first and second areas is determined based on the moving distance of the sheet 1 due to the inertia. Note that the moving distance is about (Z×0.1).

Figure 1A:
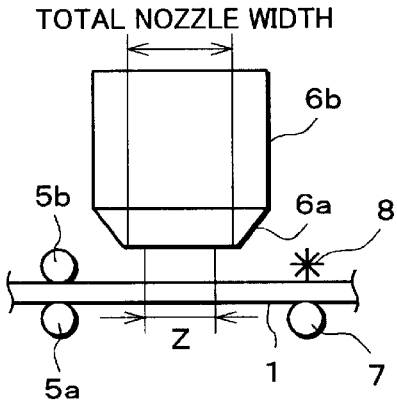
FIGS. 1(*a*) through 1(*c*) are explanatory diagrams showing the printing of the case where the amount of sheet feed after printing is less than the required amount (the ordinary amount) in a serial printer in accordance with the present invention, FIG. 1(*a*) shows the state in which the ordinary printing has been carried out, FIG. 1(*b*) shows how the printing is carried out in the case where the amount of sheet feed after printing is less than the ordinary amount, and FIG. 1(*c*) shows how the compensation is carried out with respect to the case where the amount of sheet feed is less than the ordinary amount.
Figure 1B:
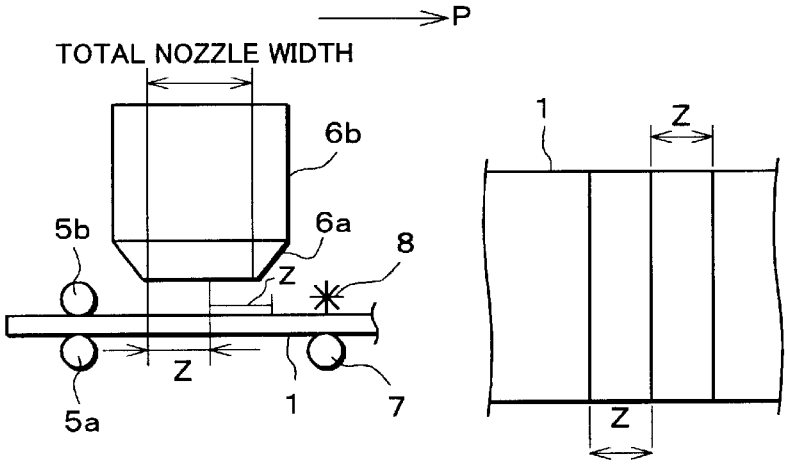
Figure 1C:
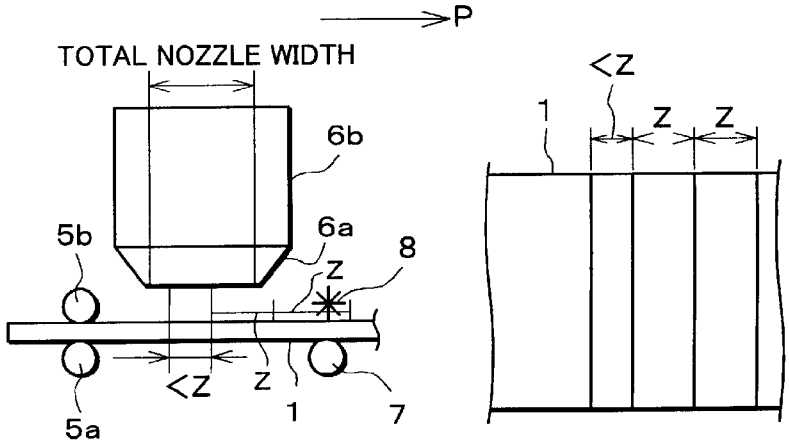
Figure 2A:
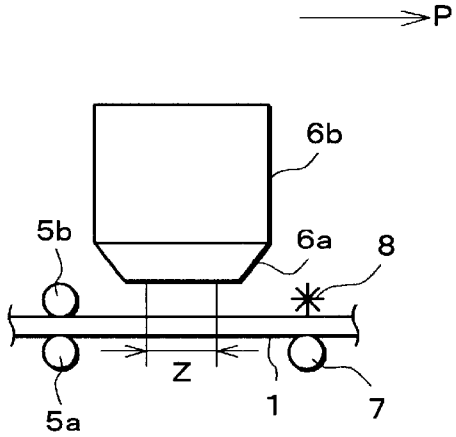
FIGS. 2(*a*) through 2(*c*) are explanatory diagrams showing the printing of the case where the amount of sheet feed after printing is more than the set amount in a serial printer in accordance with the present invention, FIG. 2(*a*) shows the state in which the ordinary printing has been carried out, FIG. 2(*b*) shows how the printing is carried out in the case where the amount of sheet feed after printing is more than the ordinary amount, and FIG. 2(*c*) shows how the compensation is carried out with respect to the case where the amount of sheet feed is more than the ordinary amount.
Figure 2B:
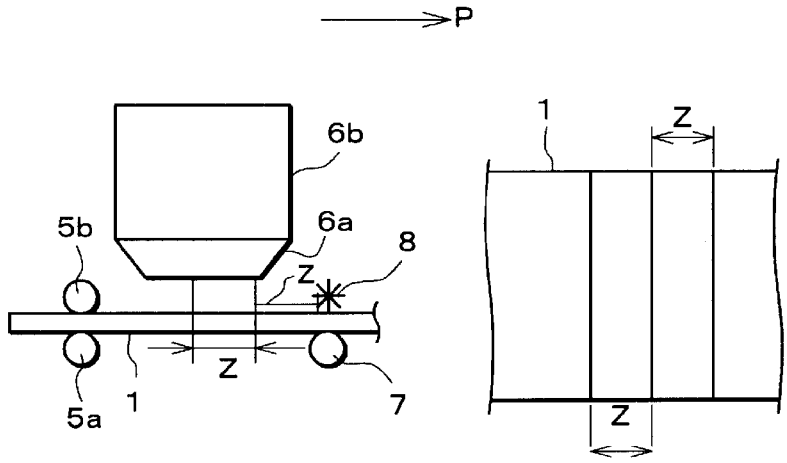
Figure 2C:
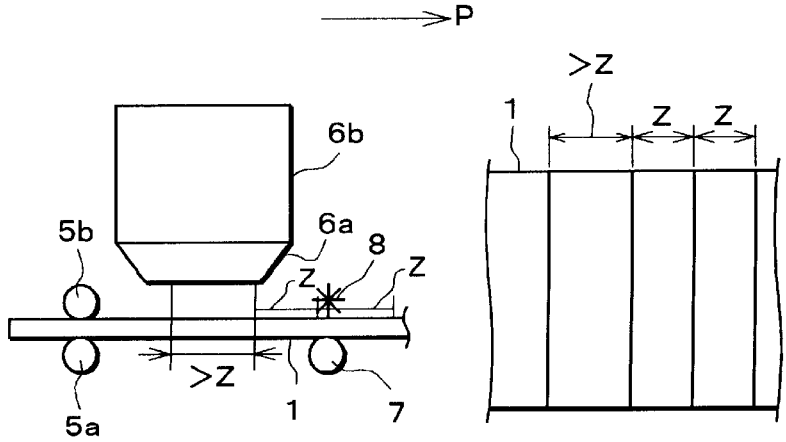
Figure 3A:
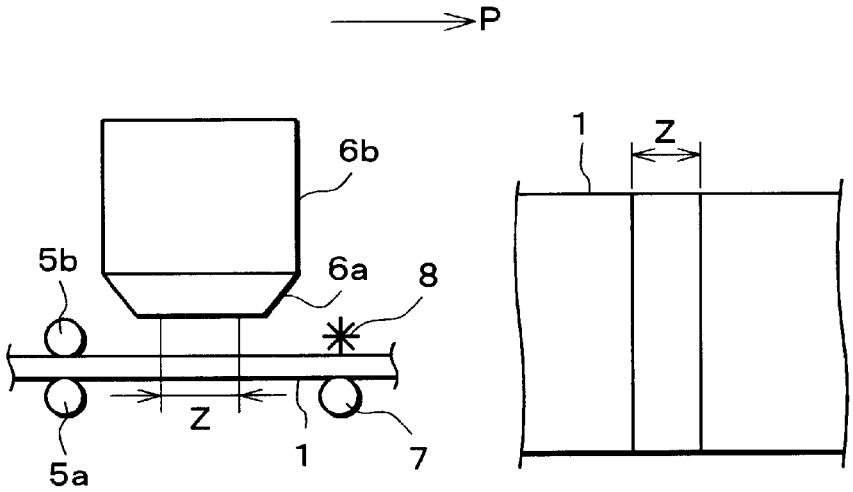
FIGS. 3(*a*) and 3(*b*) are explanatory diagrams showing the printing of the case where the amount of sheet feed after printing is coincident with the amount set in a serial printer in accordance with the present invention, FIG. 3(*a*) shows the state in which the ordinary printing has been carried out, and FIG. 3(*b*) shows the state in which another ordinary printing has been carried out.
Figure 3B:
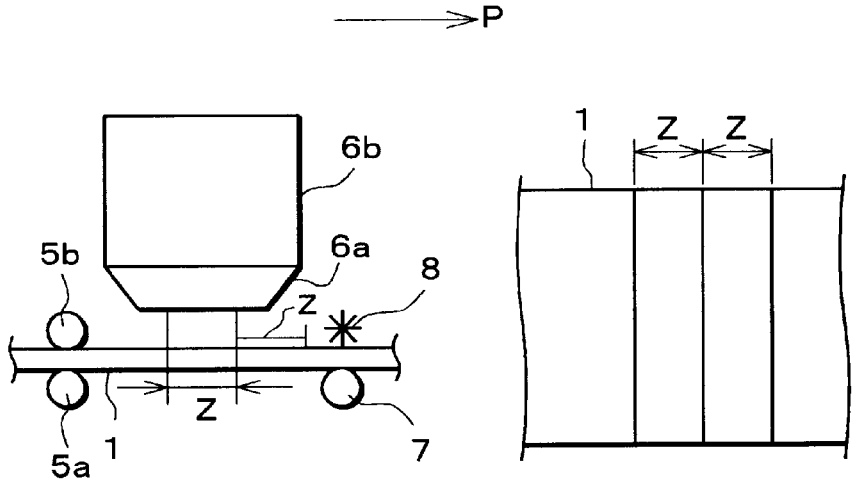

FIGS. 1 through 3 respectively show how the ink nozzles that jet the ink during the ordinary printing are selected in accordance with the feed amount of the sheet 1. FIG. 3 shows the case where the feed amount of the sheet 1 is equal to the ordinary amount (not shown in FIG. 3, but the amount corresponding to "Z" that is the number of the ink nozzles in the third area). The following description deals with the case where the feed amount of the sheet 1 is equal to the ordinary amount with reference to FIG. 3.

In FIG. 3(*a*), upon receipt of printing data (recording data) from jet section selection means such as a computer, the printing, corresponding to the print width, is carried out. The above print width corresponds to "Z" that is the number of the ink jetting nozzles used during the ordinary printing). Then, upon finishing the scanning of the ink carriage 6 for the print width, the sheet 1 is fed by the control section in the sheet feed direction P by the amount corresponding to the print width as described above. When the sheet 1 is thus fed by the amount of the print width (i.e., the width corresponding to "Z" that is the number of the ink nozzles in the third area), the printing having the same print width as that shown in FIG. 3(*a*) is carried out as shown in FIG. 3(*b*). Note that the number of the ink nozzles 20 that are used is equal to "Z" that is the number of the ink jetting nozzles used during the ordinary printing. Accordingly, in this case, (a) the first area (the number of the ink nozzles: Y1) that is used for the case where the amount of sheet feed is less than the ordinary amount and (b) the second area (the number of the ink nozzles: Y2) that is used for the case where the amount of sheet feed is more than the ordinary amount are not used (not selected).

FIG. 1 is an explanatory diagram showing the printing of the case where the amount of sheet feed, after printing of the ordinary print width, is less than the required amount (the ordinary amount).

Figure 4:
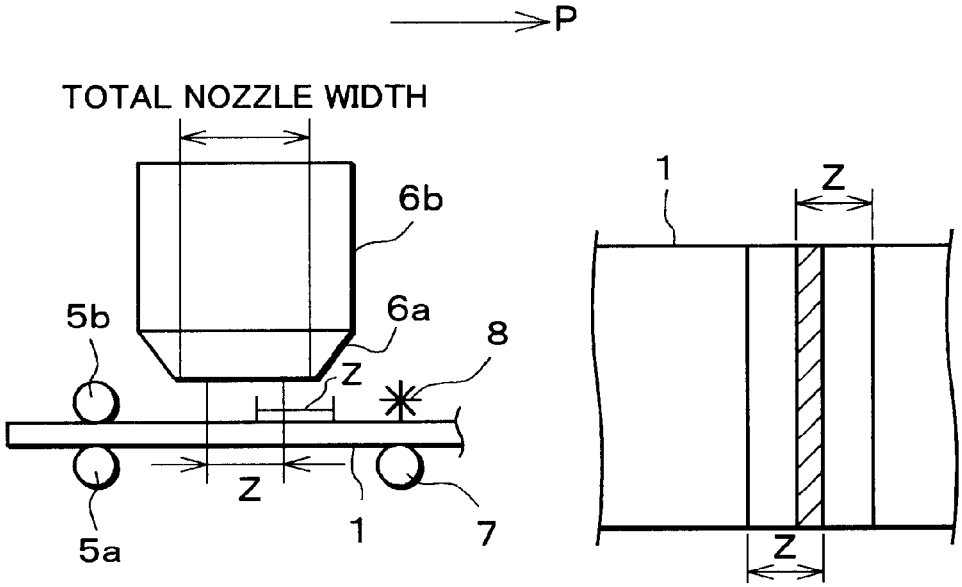
FIG. 4 is an explanatory diagrams showing the state in which the overlapping portion occurs in the printed result in the case where the arrangement of a serial printer in accordance with the present invention is not adopted, when the amount of sheet feed after printing is less than the required amount (the ordinary amount).

In the case where it is detected by the feed amount detection means that the sheet 1 has been fed by the amount of sheet feed which is less than the ordinary amount after the ordinary printing of FIG. 1(*a*) was carried out, when the printing is carried out in accordance with the ordinary number of the ink jetting nozzles ("z"), the overlapping area occurs in the printed (recorded) result (see the oblique lines of FIG. 4 and FIG. 8(*a*)), because the number of the ink nozzles that have been used is not changed.

In view of the deficiency, according to the present invention, as shown in FIG. 1(*b*), the range of the ink nozzles that are used is extended to the first area (the number of the ink nozzles is Y1) in accordance with the shortage of the feed amount, thereby avoiding the occurrence of the overlapping in the printed result. In this case, the print width has the same width as that (i.e., the width corresponding to "Z" that is the number of the ink jetting nozzles used during the ordinary printing) of the previous one, but the ink nozzles 20 (jet nozzles) that contribute to the printing are selected in the different areas. It is possible to carry out the same amount of printing as the ordinary printing as follows. More specifically, (a) the ink nozzles in the first area (Y1) on the third area (Z) side are selected and used in accordance with the shortage of the feed amount that has been detected and (b) the ink nozzles to be used in the third area (that is used during the ordinary printing) on the second area side are reduced in accordance with the shortage of the feed amount. In other words, the ink nozzles, to be used during the printing, bridges between (a) the third area that is used for the ordinary printing (the number of the ink nozzles is "Z") and (b) the first area that is used during the shortage of the sheet feed (the number of the ink nozzles is "Y1"), thereby ensuring the ordinary printing, i.e., thereby ensuring to avoid that the overlapping area occurs in the printed result.

As shown in FIG. 1(*c*), the amount of the read-out is reduced by the amount corresponding to the number of the ink nozzles that corresponds to the shortage of the amount of sheet feed thus detected, and the printing is carried out. Accordingly, in this case, the printing width becomes narrower than the ordinary print width. In FIG. 10, the printing end of this case corresponds to the broader line between (a) the third area that is used for the ordinary printing (the number of the ink nozzles is "Z") and (b) the first area that is used during the shortage of the sheet feed (the number of the ink nozzles is "Y1"). By selecting thus the ink nozzles 20 so that the printing end corresponds to the border line between the first and third areas, the third area that is used for the ordinary printing (the number of the ink nozzles is "Z") is selected for the next printing, as long as the sheet is fed in accordance with the ordinary amount of sheet feed. When the shortage of the amount of sheet feed is detected, the compensation is not made right away. This is because of the following reasons. More specifically, unless the data that have been stored in the memory are printed, the overlapping occurs in the printed result and the shortages are accumulated in the succeeding printing. In view of the circumstances, according to the arrangement of the present invention, the foregoing procedures are carried out so that the inadequate amount of sheet feed is not accumulated even when a plurality of inadequate sheet feedings occur during the printings with respect to a single sheet. Accordingly, it is possible to remarkably improve the quality of printing.

FIG. 2 shows the printing of the case where the amount of sheet feed after printing is more than the ordinary amount as shown in FIG. 3.

After the ordinary printing is carried out as shown in FIG. 2(*a*), the sheet is fed. In the case where it is detected by the feed amount detection means that the amount of sheet feed is more than the ordinary amount, when the ordinary printing is carried out, the vacant printing area (vacant recording area) indicated as the white area shown in FIG. 8(*a*) occurs because the number of the ink nozzles that have been used does not change.

In view of the foregoing problem, according to the present invention, during the next printing, the using range of the ink nozzles to be used (selected) is moved (shifted) toward the second area (the number of the ink nozzles is "Y2") in accordance with the excess amount of sheet feed, as shown in FIG. 2(*b*). This ensures to avoid the occurrence of the vacant printing area. Note that the print width is the same as the previous one, i.e., the print width corresponds to the number of the ink nozzles that jet the ink during the ordinary printing, but the different areas, in which the ink nozzles 20 (jetting nozzles contributing to the printing exist, are selected. More specifically, (a) the ink nozzles in the second area (the number of the ink nozzles is "Y2" that is used during the excess of the amount of sheet feed) on the third area side are used in accordance with the excess amount of sheet feed thus detected, and (b) the ink nozzles to used in the third area (the number of the ink nozzles is "Z" that is used during the ordinary printing) on the first area side are reduced in accordance with the excess amount of sheet feed thus detected, thereby ensuring to carry out the ordinary amount of printing, i.e., ensuring to avoiding the occurrence of the vacant printing area. In other words, the ink nozzles, to be used during the printing, bridges between (a) the third area that is used for the ordinary printing (the number of the ink nozzles is "Z") and (b) the second area that is used during the excess of the sheet feed (the number of the ink nozzles is "Y2"), thereby ensuring the ordinary amount of printing.

As shown in FIG. 2(*c*), the amount of the read-out is increased by the amount corresponding to the number of the ink nozzles that corresponds to the excess of the amount of sheet feed thus detected, and the printing is carried out. Accordingly, in this case, the printing width becomes broader than the ordinary print width. In FIG. 10, the printing end of this case corresponds to the border line between (a) the third area that is used for the ordinary printing (the number of the ink nozzles is "Z") and (b) the second area that is used during the excess of the sheet feed (the number of the ink nozzles is "Y2"). By selecting thus the ink nozzles 20 so that the printing end corresponds to the border line between the second and third areas, the third area that is used for the ordinary printing (the number of the ink nozzles is "Z") is selected for the next printing, as long as the sheet is fed in accordance with the ordinary amount of sheet feed.

When the excess of the amount of sheet feed is detected, the compensation is not made right away. This is because of the following reasons. More specifically, unless the data that have been stored in the memory are printed, the vacant area occurs in the printed result and the excesses are accumulated in the succeeding printing. In view of the circumstances, according to the arrangement of the present invention, the foregoing procedures are carried out so that the inadequate amount of sheet feed is not accumulated even when a plurality of inadequate sheet feedings occur during the printings with respect to a single sheet. Accordingly, it is possible to remarkably improve the quality of printing.

As has been described above, it is clear that it is dissolve the inadequate printings such as the overlapping of images and the vacant area in the image without complicated controlling for the amount of sheet feed unlike the conventional arts, by detecting the amount of sheet feed after a single ink carriage finished scanning so that the areas, in which the ink nozzles to be used in the printing process followed by the next printing process exist, can be changed in accordance with the amount of sheet feed thus detected.

The following description deals with a concrete example of the procedures to be adopted during the inadequate feed amount.

As mentioned earlier, in the ink jet printer having a scanner shown in FIG. 5, the optical unit 50 scans the original document on the platen glass 51 so as to read the image on the original document. The control section (not shown) of the ink jet printer is provided with the first through third memories (not shown). The first memory stores the image information that has been read out by the optical unit 50. The second memory stores print information. The print information is obtained as follows: the image information, that has been stored by the first memory, has been subjected to image processing so as to obtain the print information. One part is removed from the print information and the remaining of the print information is stored in the third memory as the ink head transmittance information to be transmitted to the ink head 6*a*.

Memories having a small recording capacity are used as the respective first through third memories in considerations of factors such as (a) the size and cost of the apparatus and (b) the fact that the serial printing causes the ink head 6*a* not to cover the large print area by a single scanning. In order to effectively use the memories having such a small recording capacity, the read-out is carried out with respect to such memories having a small recording capacity in a manner so that the original document area (the sub-scanning direction) is divided into a plurality of areas. The number of such divisions changes a little depending on (a) the amount of image information in the original document (corresponding to the change in the recording capacity due to the image compression in the memory) and (b) the area in which a single scanning allows the ink head 6*a* to print.

Figure 12:
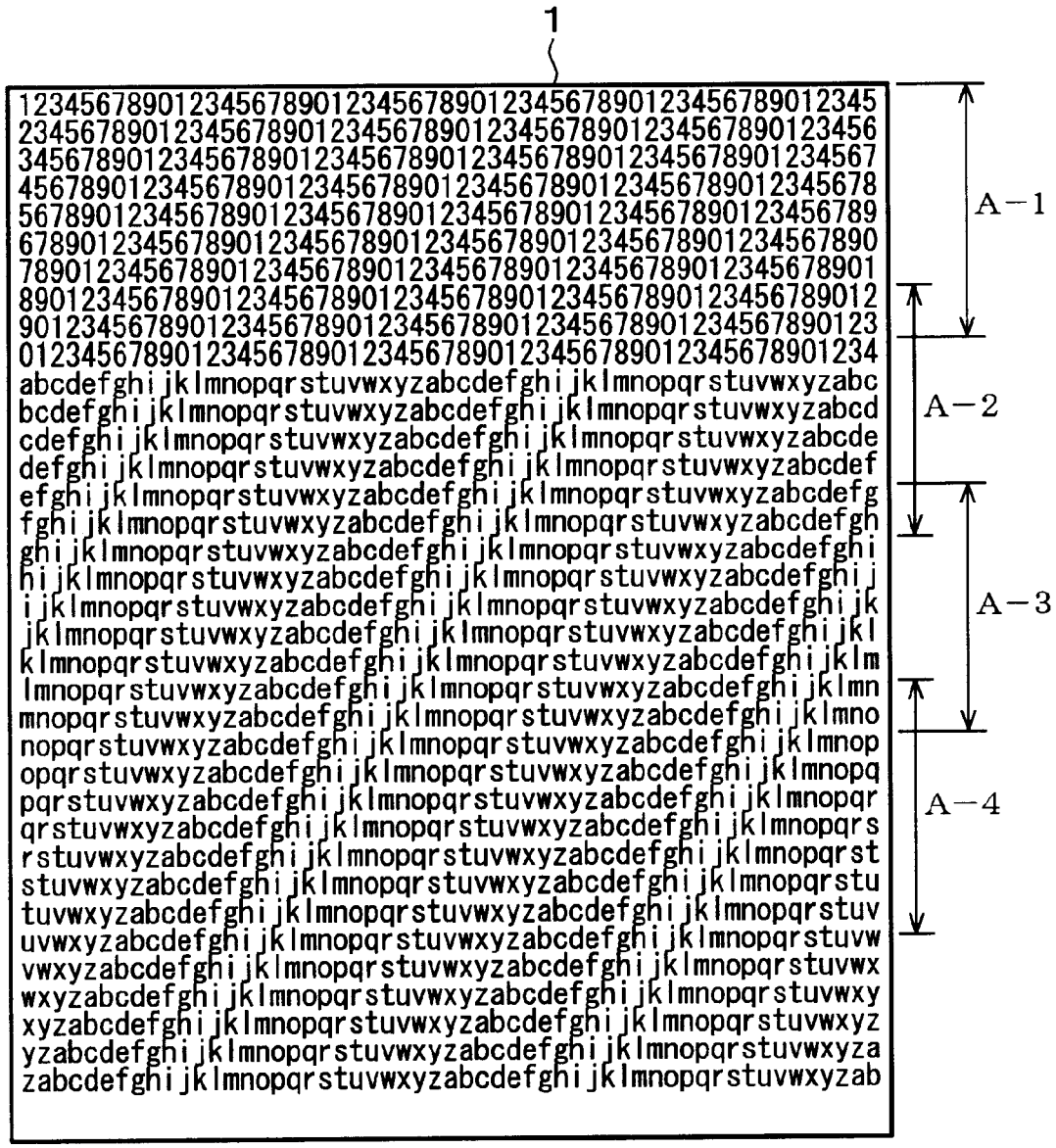
FIG. 12 is an explanatory diagram showing how a single original document is read out in a plurally divided manner, such an original document being one example.

The following description deals with how the readout is carried out with respect to a single original document plurally in a division manner with reference to FIG. 12 showing one example of such a single original document.

For example, in FIG. 12, each of areas A-1, A-2, A-3, A-4, . . . , is indicative of the area which can be read out by the optical unit 50 during a single read-out in the original document. Note that each read-out is carried out so that the overlapping area inevitably occurs. FIG. 12 shows the case where the area which can be ordinarily read out during a single read-out contains the information corresponding to 9 lines.

The overlapping area is used during the image processing for maintaining the unity (continuity) of the information that has already been read out and the information that will be read out next in accordance with such as the brightness of the image information that has been read out. Note that it is possible even in a single original document that the read-out area of the image information and the hue respectively vary depending on whether the illumination from the light source is small or large.

Figure 13:
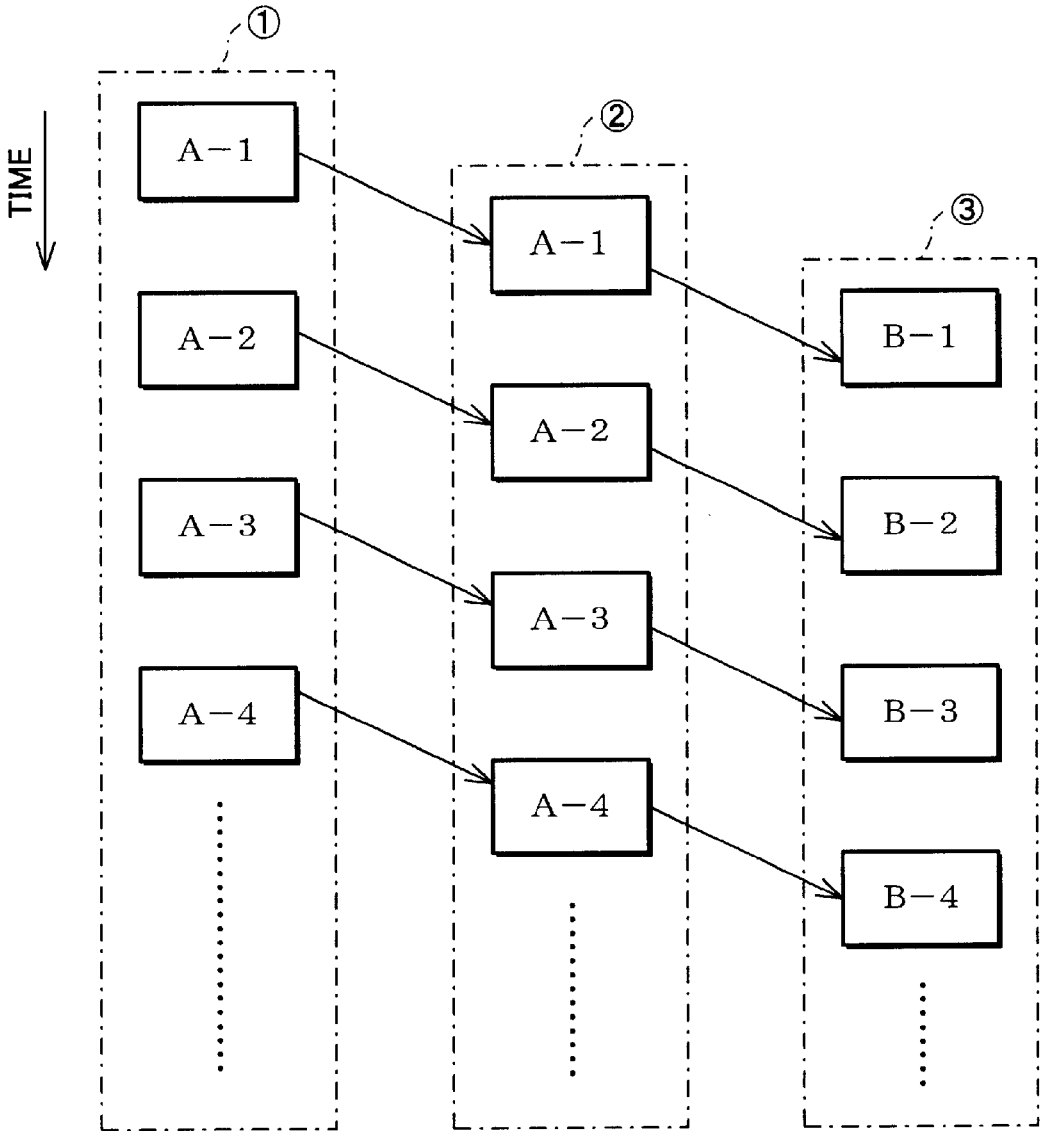
FIG. 13 is an explanatory diagram showing how the data are stored as time goes on in the first through third memories of the present invention.
Figure 14A:
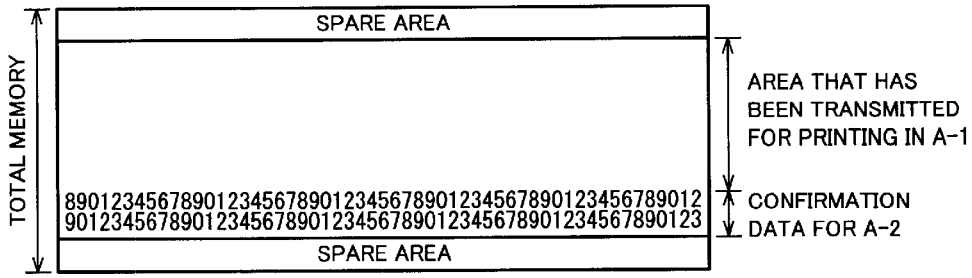
FIGS. 14(*a*) through 14(*e*) are explanatory diagrams showing how the data are transmitted in the ordinary state in FIG. 13.
Figure 14B:
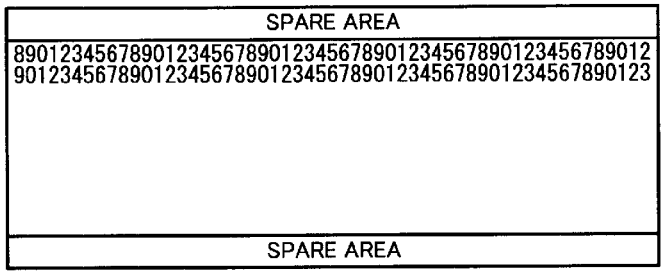
Figure 14C:
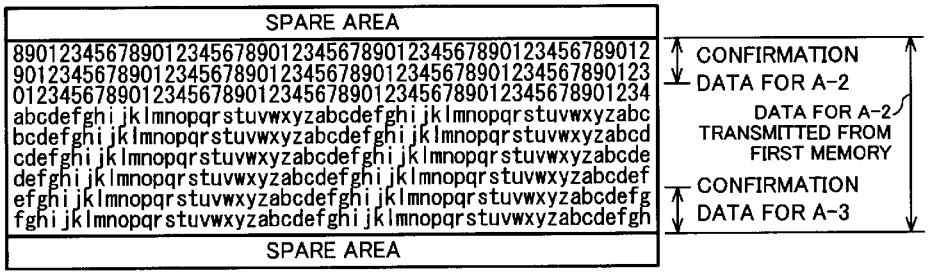
Figure 14D:
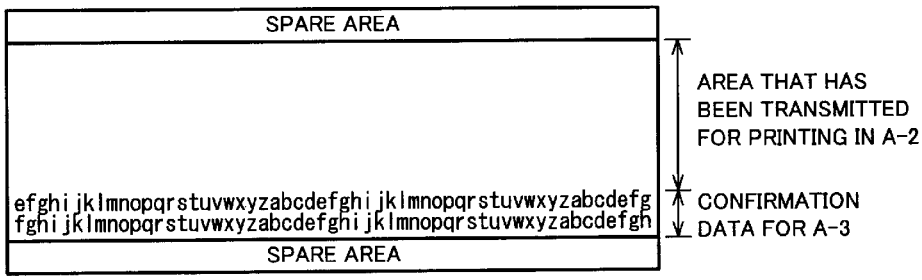
Figure 14E:
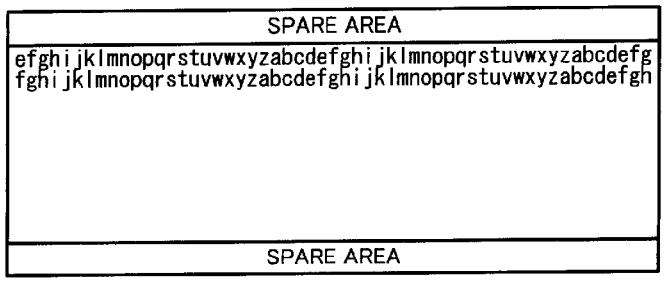
Figure 15A:
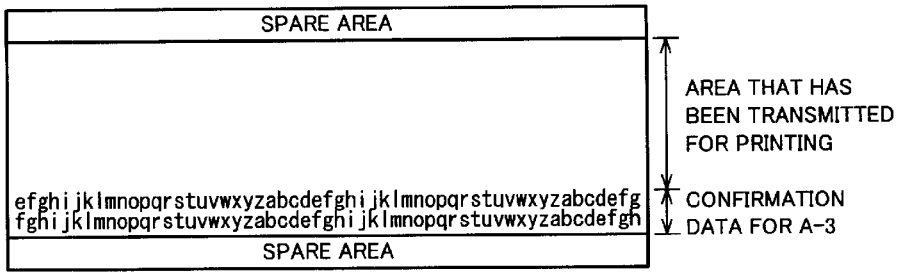
FIGS. 15(*a*) through 15(*e*) are explanatory diagrams showing how the data are transmitted when the amount of sheet feed is large.
Figure 15B:
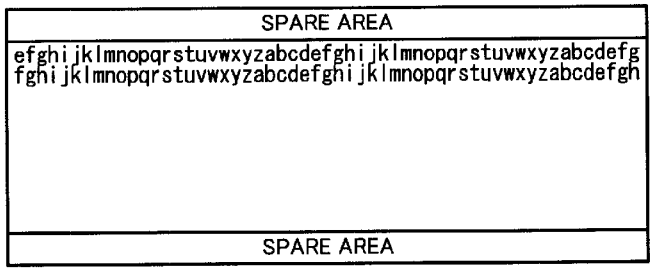
Figure 15C:
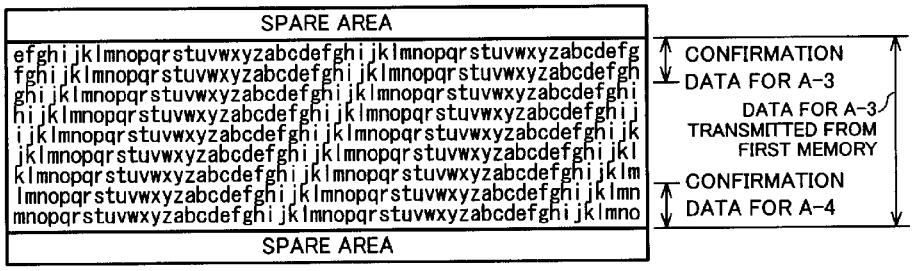
Figure 15D:
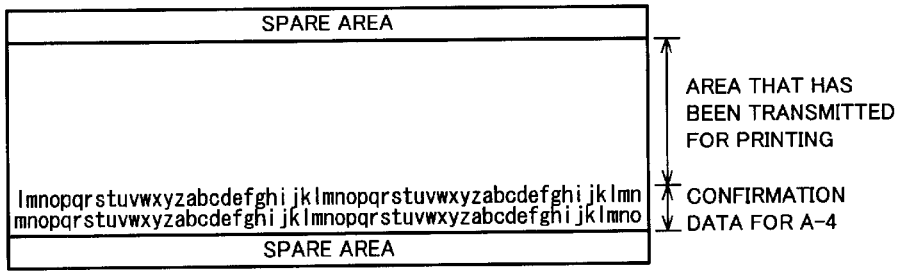
Figure 15E:
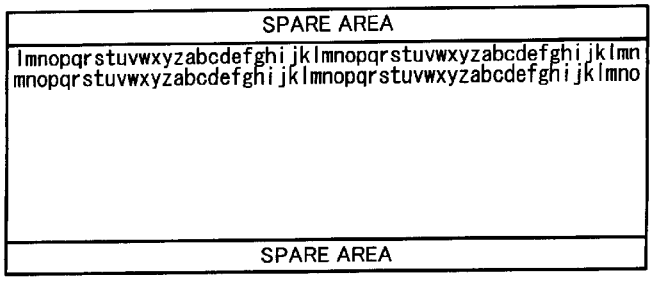

The image information thus read out is transmitted as shown in FIG. 13. FIG. 13 is an explanatory diagram showing how the data are stored and transmitted as time goes on. A processing ① shown in FIG. 13 indicates the processing in which the original document are read out through the optical unit 50 and the resultant is stored in the first memory as the image information. A processing ② shown in FIG. 13 indicates the processing in which the image information that has been stored in the first memory in the processing ① is subjected to a predetermined processing and the resultant thus processed is stored in the second memory as the print information. A processing ③ shown in FIG. 13 indicates the processing in which the print information transmitted from the second memory is suitably transmitted to the ink head 6*a*. Note that arrows illustrated among the processings ①, ②, and ③ respectively indicate the transmittances of data among the first, second, and third memories.

In FIG. 13, the symbols A-1, A-2, A-3, A-4, . . . of the processing ① indicate the image information corresponding to areas A-1, A-2, A-3, A-4, . . . , in the original document shown in FIG. 12, respectively. The symbols A-1, A-2, A-3, A-4, . . . , of the processing ② indicate the print information corresponding to the image information A-1, A-2, A-3, A-4, . . . , stored in the first memory, respectively. The symbols B-1, B-2, B-3, B-4, . . . of the processing ③ indicate the respective ink head transmittance information that are actually transmitted to the ink head.

Further, in FIG. 13, the processings ①, ②, and ③ are parallelly (concurrently) carried out for improving the efficiency in the printing processing and the efficiency in the read-out processing. For example, the data in the area A-3 are read out by the optical unit 50 and consecutively stored in the first memory while the ink head transmittance information B-2 is transmitted to the ink head in the processing ③.

The following description deals with how the processing ② is carried out during the parallel processing with reference to FIGS. 14 through 17.

When the processings such as the sheet feeding are normally carried out, in the processing ①, the data in the area A-1 of the original document are read out by the optical unit 50 and stored in the first memory as the image information. The image information is subjected to a predetermined image processing and is stored in the second memory as the print information in the processing ②.

As shown in FIG. 14(*a*), the print information, that has been stored in the second memory in the processing ②, is transmitted to the third memory so as to be stored as the ink head transmittance information B-1 in the processing ③. During the processing, the data of the aftermost part (corresponding to the last 2 lines of the image information in FIG. 14(*a*)) among the data that have been transmitted from the first memory to the second memory are remained in the second memory as the confirmation data for A-2 without being transmitted to the third memory so as to maintain the continuity (unity) of the data (A-2) to be transmitted to the third memory next. The confirmation data for A-2 thus remained are transmitted to the head part in the second memory as shown in FIG. 14(*b*).

The processing relating to the storing of the ink head transmittance information B-1 is carried out, and concurrently the data in the area A-2 of the original document are read out by the optical unit 50 and are stored in the first memory as the image information in the processing ①.

The image information concerning the area A-2 is subjected to the predetermined image processing and is stored in the second memory as the print information in the processing ②. During this processing, in order to maintain the unity (continuity) of the print information, it is confirmed by the control section that the data of the aftermost part (corresponding to the first 2 lines of the image information in FIG. 14(*b*)) that have been read out are coincident with the confirmation data for A-2. The image information in which the unity (continuity) has been maintained, as shown in FIG. 14(*c*), is subjected to the image processing with the state in which the unity (continuity) of the data in the area A-1 and the data in the area A-2 maintained, and is stored in the second memory as the print information.

The print information, as described above, is transmitted to the third memory and is stored therein as the ink head transmittance information B-2. During the processing, the data of the aftermost part among the data that have been transmitted from the first memory to the second memory are remained in the second memory as the confirmation data for A-3 without being transmitted to the third memory so as to maintain the continuity (unity) of the data (A-3) to be transmitted to the third memory next. The confirmation data for A-3 thus remained are transmitted to the head part in the second memory as shown in FIG. 14(*e*).

The foregoing processings are repeated with respect to the areas A-3, A-4, . . . , and the single original document of FIG. 12 is read out plurally in a division manner so as to be stored in the first through third memories, respectively. During the processing, when the read-out of the original document, sheet feeding, and printing processing are normally carried out, by repeating the processings of FIGS. 14(*a*) through 14(*e*), the printings are consecutively carried out with respect to the single original document, thereby ensuring to avoid that the vacant area and/or the overlapping occur(s) in the printed result.

Note that the transmittance of the print information to the third memory is carried out in accordance with the remaining capacity (unrecorded capacity) of a memory (not shown) in the ink head 6*a*. Note also that the using range, in which the ink nozzles 20 to be used during the ordinary printing exist, is indicated as "b" in FIG. 17.

Figure 16A:
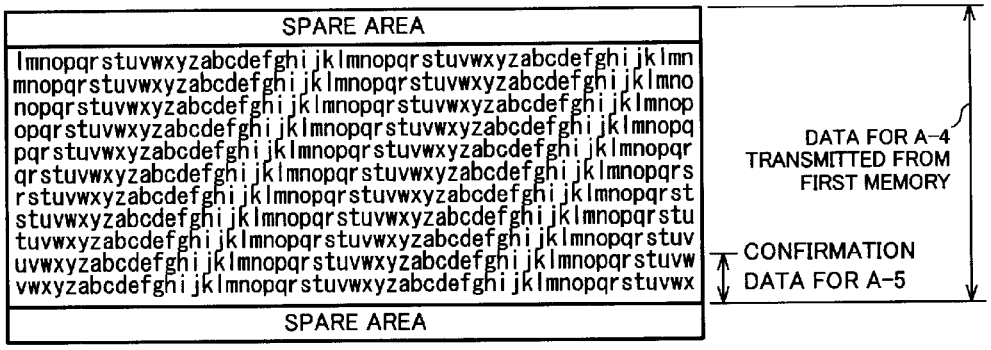
FIGS. 16(*a*) through 16(*c*) are explanatory diagrams showing the procedure following the data transmittance shown in FIGS. 15(*a*) through 15(*e*).
Figure 16B:
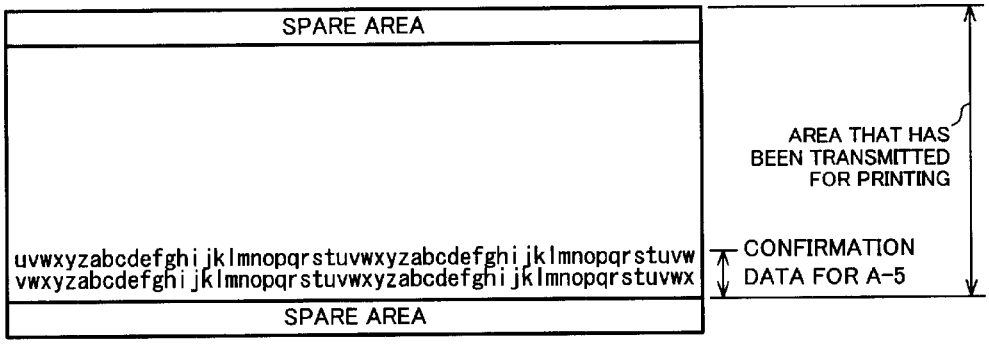
Figure 16C:
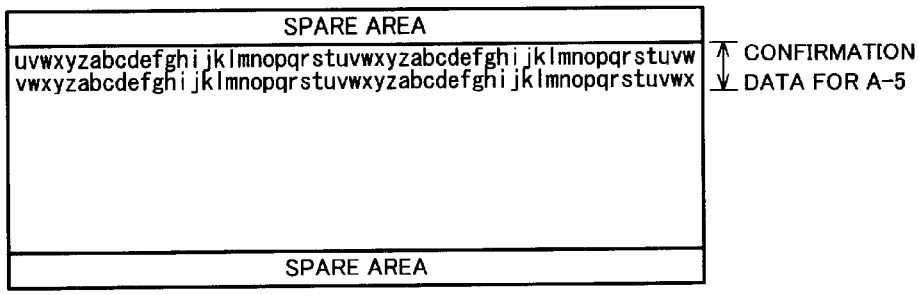

The following description deals with the case where the amount of sheet feed has been more than the ordinary amount during the transmittance of the print information of FIG. 14(*d*) to the third memory with reference to FIGS. 15(*a*) through 15(*e*) and FIGS. 16(*a*) through 16(*c*).

It is detected by the feed amount detection means that the sheet has been fed more than the predetermined amount during the transmittance of the data shown in FIG. 14(*d*). At this stage, since the optical unit 50 is reading out the data in the area A-3 of the original document, this read-out operation is continued without suspension as shown in FIGS. 15(*a*) through 15(*e*). Note that the read-out operation is carried out in a similar manner to the processings shown in FIGS. 14(*a*) through 14(*e*). Note also that the processings shown in FIGS. 14(*d*) and 14(*e*) are the same as those shown in FIGS. 15(*a*) and 15(*b*). Accordingly, the detailed explanation is omitted here.

More specifically, first, in the processing ①, the data in the area A-3 of the original document are read out by the optical unit 50, and are stored in the first memory as the image information (A-3). The image information, as shown in FIG. 15(*c*), is subjected to the predetermined image processing and is stored in the second memory as the print information A-3 in the processing ②. Then, the print information (A-3) that has been stored in the second memory during the processing ② is transmitted to the third memory and is stored therein as the ink head transmittance information B-3. During this processing, the data of the aftermost part (corresponding to the last 2 lines of the image information in FIG. 15(*d*)) among the data, that have been transmitted from the first memory to the second memory, are remained in the second memory as the confirmation data for A-4 without being transmitted to the third memory so as to maintain the continuity (unity) of the data (A-2) to be transmitted to the third memory next. The confirmation data for A-4 thus remained are transmitted to the head part in the second memory as shown in FIG. 15(*e*).

Figure 17:
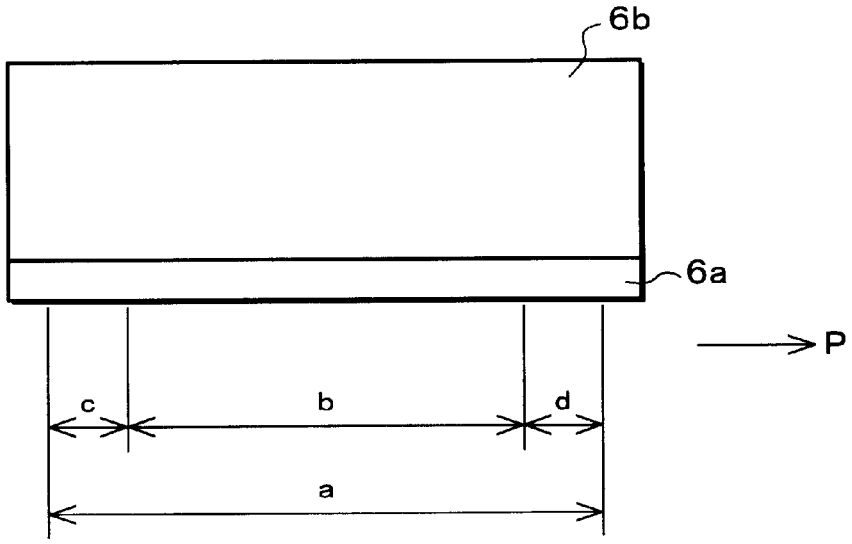
FIG. 17 is an explanatory diagram showing the range in which ink nozzles of the present invention can be used.

Note that, in FIGS. 15(*a*) through 15(*e*), the using range, in which the ink nozzles 20 to be used during the printing exist, bridges between the areas respectively indicated as "b" and "d" in FIG. 17, but the total number of the ink nozzles to be used is equal to the total number (print width) of the area indicated as "b". As a matter of fact, in this case, the ink nozzles that are located on the "b" side (near to the area "b") in the area indicated as "d" are selected and used in accordance with the excess of the sheet feed, while the ink nozzles that are located on the "c" side (near to the area "c") in the area indicated as "b" are not selected and used in accordance with the excess of the sheet feed.

Concurrently, during the read-out of the original document in the processing ①, the compensation is carried out for the moving (shifting) of the using range of the ink nozzles 20 as follows. More specifically, the optical unit 50 reads out the area that is larger than usual (here, it is assumed that the image information corresponding to two lines is read out more than usual), and stores the read-out result in the first memory as the image information (A-4). The image information, as shown in FIG. 16(*a*), is subjected to the predetermined image processing in the processing ②, and stored in the second memory as the print information (A-4). At this time, in the second memory, used is a spare area that is provided on the aftermost side as shown in FIG. 16(*a*).

As shown in FIG. 16(*b*), the print information (A4) that has been stored in the second memory in the processing ② is transmitted to the third memory, and is stored in the third memory as the ink head transmittance information in the processing ③. During the processing, as shown in FIG. 16(*b*), the data of the aftermost part among the data that have been transmitted from the first memory to the second memory are remained in the second memory as the confirmation data for A-5 without being transmitted to the third memory so as to maintain the continuity (unity) of the data (A-5) to be transmitted to the third memory next. The confirmation data for A-5 thus remained are transmitted to the head part in the second memory as shown in FIG. 16(*c*).

As described above, the ink head transmittance information B-3 having the ordinary amount is printed by using the ink nozzles 20 so that (a) the ink nozzles 20 that are located in the area bridging between the areas indicated as "b" and "d" in FIG. 17 and (b) the total number of the ink nozzles 20 thus selected is equal to the total number of the area indicated as "b". Then, the ink head transmittance information B-4 whose amount is more than the ordinary amount is transmitted to the third memory for the printing. The ink nozzles 20 used during the printing are located in the area bridging between the areas indicated as "b" and "d" in FIG. 17. As a matter of fact, in this case, the ink nozzles that are located on the "b" side (near to the area "b") in the area indicated as "d" are selected in accordance with the excess of the sheet feed, and all the ink nozzles that are located in the area indicated as "b" are selected and used. This allows the next printing and its succeeding printings to carry out the ordinary printing with the use of the ink nozzles located in the area indicated as "d", unless another inadequate sheet feeding occurs.

By thus selectively using the ink nozzles 20, the ordinary printings are carried out after FIG. 16(*a*) in a similar manner as shown in FIGS. 14(*a*) through 14(*e*). This allows to avoid that the vacant area and/or overlapping area occur(s) in the printed result even when the sheet is fed more than usual during the printing. Accordingly, the continuity of the image information that has been read out is maintained before and after the excess of the sheet feed, thereby avoiding that the lack of image information occurs.

After the smaller amount of printing than usual is carried out, as long as no further inadequate feeding occurs, the ink nozzles in the area indicated as "b" in FIG. 17 are selected and used for the ordinary printing. This allows the excess of the feed amount not to be accumulated in the succeeding printings, thereby ensuring to carry out the printing with extremely high reliance.

The foregoing description deals with the case where the amount of sheet feed increases by the amount corresponding to two lines of the original document shown in FIG. 12 compared with the ordinary case. However, the present invention is not limited to this. For example, by using the spare areas respectively provided in the vicinity of the head and aftermost parts or by enlarging the capacity of each spare area, it is possible to deal with more excess of the feed amount. Note that it is preferable that the spare areas occupy 10 percent to 15 percent of the entire capacity. This is because it is difficult to cope with the inadequate feed amount when the spare areas occupy less than 10 percent of the entire capacity and it is difficult to compact the apparatus and to reduce the costs as a whole when the spare areas occupy more than 15 percent of the entire capacity The foregoing description deals with the case of the processings when the excess of the amount of sheet feed occurs. In the case of the shortage of the amount of sheet feed, it is possible to avoid that the vacant area and/or the overlapping area occur(s) in the printed result even when the unevenness of sheet feeding occurs during feeding of a single sheet, by changing the area, in the original document, to be read out and by changing the using range in which the ink nozzles to be used are located.

More specifically, during the transmittance of the data shown in FIG. 14(*d*), when it is detected by the feed amount detection means that the feed amount was less than the ordinary amount, carried out are the processings shown in FIGS. 15(*a*) through 15(*e*) that are same as the case of the excess of the amount of sheet feed. Namely, when the shortage of the feed amount is detected, the ink nozzles 20 are selected so that the ink nozzles belong to the area which bridges between the areas respectively indicated as "b" and "c" in FIG. 17 and the total number of the ink nozzles is equal to the total number (print width) of the area indicated as "b", thereby ensuring to print the ink head transmittance information B-3 having the ordinary amount.

In this case, the using range, in which the ink nozzles 20 to be used during the printing exist, bridges between the area indicated as "b" and "c" in FIG. 17. As a matter of fact, in this case, the ink nozzles that are located on the "b" side (near to the area "b") in the area indicated as "c" are selected and used in accordance with the shortage of the sheet feed, while the ink nozzles that are located on the "d" side (near to the area "d") in the area indicated as "c" are not selected and used in accordance with the shortage of the sheet feed.

Instead of FIG. 16(*a*), not shown in the drawing, the compensation is carried out for the moving (shifting) of the using range of the ink nozzles 20 as follows. More specifically, the optical unit 50 reads out the area that is narrower than usual, and stores the read-out result in the first memory as the image information (A-4). The image information is subjected to a predetermined image processing, and stored in the second memory as the print information (A-4). At this time, the second memory is not entirely but partially used. The shortage of the amount of sheet feed is subtracted from the print information having the ordinary amount, and the subtracted result is transmitted to the third memory to be stored therein.

During this, the using range of the ink nozzles 20 falls within the area indicated as "b" in FIG. 17. As a matter of fact, in this case, the ink nozzles that are located on the "d" side (near to the area "d") in the area indicated as "b" are not selected and used in accordance with the shortage of the sheet feed. This allows that as long as no further inadequate feeding occurs, the ink nozzles in the area indicated as "d" in FIG. 17 are selected and used for the next printing and its succeeding printings. This allows the excess of the feed amount not to be accumulated in the succeeding printings, thereby ensuring to carry out the printing with extremely high reliance.

As described above, the continuity of the image information that has been read out is maintained before and after the shortage of the sheet feed, thereby avoiding that the overlapping of the image information occurs. Further, after the smaller amount of printing than usual is carried out, as long as no further inadequate feeding occurs, the ordinary printing is carried out. This allows the shortage of the feed amount not to be accumulated in the succeeding printings, thereby ensuring to carry out the printing with extremely high reliance.

A serial recording apparatus in accordance with the present invention, as has been described above, is provided with at least one recording means for jetting visualizing agent toward a recording medium via a plurality of jet sections, in which information corresponding to 1 line is recorded on the recording medium while the recording medium is fed and scanned in a first direction, and feed means feeds the recording medium in a second direction, is characterized by further comprising (a) feed amount detection means for detecting feed amount of the recording medium by the feed means in the second direction after each scanning finishes, and (b) jet section selecting means such as a computer for selecting jet sections to be used for recording among the plurality of jet sections in accordance with the feed amount that has been detected by the feed amount detection means.

According to the invention, the visualizing agent is jetted toward the recording medium via the jet sections, while at least one recording means are fed and scanned in the first direction, thereby resulting in that the information corresponding to 1 line is recorded. When the information corresponding to 1 line is recorded, the recording medium is fed by the feed means in the second direction. Then, the information corresponding to the next line is recorded in a similar manner to the above-mentioned procedure. By repeating the procedure, the information is continuously recorded on a single recording medium.

It may happen that the feed amount of the recording medium is not coincident with the target amount due to some reasons, during the feeding of the recording medium in the second direction so as to record in the next line the information corresponding to the next line. Namely, the feed amount of the recording medium may become more or less than the ordinary amount. In this case, according to the conventional art, since all the jet sections are used so as to jet the visualizing agent, although the recording should have been carried out continuously, a vacant area occurs in the recording result when the feed amount is more than the ordinary amount while an overlapping area is occurs in the recording result when the feed amount is less than the ordinary amount. This causes the problem that the quality of the recording remarkably deteriorates.

In order to solve the problem, according to the present invention, the feed amount of the recording medium in the second direction is detected, and based on the feed amount that has been thus detected, the jet sections to be used for recording the information corresponding to the next line are selected among the plurality of jet sections. Accordingly, only the jet sections that have been thus selected jet the visualizing agent toward the recording medium.

More specifically, after the scanning of 1 line is carried out, the recording medium is fed in the second direction by the feed means. Thereafter, the scanning of the next line is carried out. The feed amount is detected by the feed amount detection means. Based on the feed amount that has been thus detected, the jet sections to be used for the recording of the next line are selected among the plurality of jet sections by the jet section selecting means. This allows to continuously record the information on the recording medium, even when the feed amount becomes more or less than the ordinary amount, without the vacant area and/or the overlapping area in the recording result, by changing the selection of the jet sections in the recording means that contributes to the recording. Therefore, it is possible to avoid that the inadequate recording occurs.

For example, when the recording medium is fed by the ordinary feed amount in the second direction, it is assumed that the visualizing agent is jetted toward the recording medium via a predetermined number of jet sections so as to carry out the recording of the information. When the recording medium is fed more than the ordinary amount in the second direction, jet sections on the upstream side in the second direction are selected more than usual in accordance with the feed amount that has been detected. Such jet sections contribute to the recording, so that it is possible to continuously record the information with respect to the area that will be the vacant area according to the conventional art.

In contrast, when the recording medium is fed less than the ordinary amount in the second direction, (a) jet sections on the downstream side in the second direction are selected more than usual in accordance with the feed amount that has been detected and (b) jet sections on the upstream side in the second direction are selected less than usual in accordance with the feed amount that has been detected. Such jet sections contribute to the recording, so that it is possible to record the information with respect to the area that will be the overlapping area according to the conventional art.

The following arrangement is preferable. More specifically, the recording means is provided with (a) a first area in which a plurality of jet sections are provided in the vicinity of an end part of the recording means on the upstream side in the second direction, (b) a second area in which a plurality of jet sections are provided in the vicinity of an end part of the recording means on the downstream side in the second direction, (c) a third area, other than the first and second areas, in which a plurality of jet sections are provided. The jet section selecting means (1) selects all the jet sections in the third area when the recording medium is fed by the ordinary feed amount in the second direction, (2) selects the jet sections among the first through third areas in accordance with the feed amount that has been detected, when the recording medium is fed more than the ordinary amount in the second direction, and (3) selects the jet sections among the second and third areas in accordance with the feed amount that has been detected, when the recording medium is fed less than the ordinary amount in the second direction.

In this case, when the recording medium is fed by the ordinary feed amount in the second direction, all the jet sections in the third area are selected by the jet section selecting means. The visualizing agent is jetted toward the recording medium via the jet sections that have been thus selected so as to record the information on the recording medium.

In the case where the recording medium is fed more than the ordinary amount in the second direction, when the recording is carried out in a similar manner to the ordinary case, it is most likely to occur a vacant area in the recording result. In order to meet the deficiency, according to the present invention, the jet sections are selected among the first through third areas by the jet section selecting means in accordance with the feed amount that has been detected. This allows (a) the jet sections in the area which is larger than usual to be selected and (b) the visualizing agent to jet toward the recording medium via the jet sections that have been thus selected so as to record the information on the recording medium. Accordingly, it is possible to continuously record the information with respect to the area that will be the vacant area according to the conventional art.

In the case where the recording medium is fed less than the ordinary amount in the second direction, when the recording is carried out in a similar manner to the ordinary case, it is most likely to occur an overlapping area in the recording result. In order to meet the deficiency, according to the present invention, the jet sections are selected among the second and third areas by the jet section selecting means in accordance with the feed amount that has been detected. In this case, when jet sections on the upstream side of the third area in the second direction are not selected in accordance with the required number, the jet sections that have not been thus selected do not contribute to the recording. The visualizing agent is jetted toward the recording medium via the jet sections that have been selected so as to record the information, so that it is possible to continuously record the information with respect to the area that will be the overlapping area according to the conventional art.

Some feed amount allows to record the information with the same recording width (the width in the second direction) as the ordinary recording, by selecting the jet sections in the areas other than the area of the ordinary recording.

It is preferable that the jet section selecting means is arranged so that when the recording medium is fed more than the ordinary amount in the second direction, the number of the jet sections selected in the second area is increased in accordance with the excess of feed amount and the jet sections selected in the areas other than the second area are fixed (not changed). In contrast, when the recording medium is fed less than the ordinary amount in the second direction, the number of the jet sections selected in the third area is reduced in accordance with the shortage of feed amount and the jet sections selected in the areas other than the third area are fixed (not changed).

With the arrangement, since the number of the jet sections selected in the second area is increased in accordance with the excess of feed amount and the jet sections selected in the areas other than the second area are fixed, when the recording medium is fed more than the ordinary amount in the second direction, it is possible to carry out the recording in the next line with the same recording width (the width in the second direction) as the ordinary one.

Similarly, since the number of the jet sections selected in the third area is reduced in accordance with the shortage of feed amount and the jet sections selected in the areas other than the third area are fixed, when the recording medium is fed less than the ordinary amount in the second direction, it is possible to carry out the recording in the next line with the same recording width (the width in the second direction) as the ordinary one.

Namely, it is ensurely possible to avoid the inadequate recording without damaging the quality of the recording even when it continuously occurs that the feed amount is more or less than usual.

It is preferable that the number of the jet sections in each of the first and second areas is 10 percent of that in the third area.

With the arrangement, each of the first and second areas has the jet sections whose number is 10 percent of that in the third area. Upon completion of the recording in 1 line, the recording medium is fed in the second direction, and then stops so as to record the information based on a stopping instruction. Note that it takes a little for the recording medium to stop since such a stopping instruction is entered. More specifically, the recording medium stops after the recording medium is fed in accordance with the inertia. The feed amount of the recording medium in the second direction due to the inertia is about 10 percent of the number of the jet sections in the third area. The jet sections in the first and second are selected in the foregoing manner, taking the inertia into consideration. Thus, the number of the jet sections in the first and second areas is limited, thereby enabling to reduce the cost and to simplify the structure of the apparatus as a whole because it is not necessary to provide any excessive jet sections.

It is preferable that the feed means is composed of a feed roller and its idler roller, and the feed amount detection means detects the feed amount in accordance with the amount of revolution of the feed roller or the idler roller.

In this case, when the feed roller and its idler roller rotate, the recording medium is fed in the second direction in accordance with the revolution of the rollers. The feed amount detection means detects the feed amount of the recording medium in the second direction in accordance with the amount of revolution of the feed roller or the idler roller. The feed amount of the recording medium in the second direction is found based on the circumference length of the feed roller or the idler roller.

It is preferable that the feed means is composed of pairs of a feed roller and its idler roller, (a) a first pair of feed roller and its idler roller are provided in the vicinity of the recording medium and on the downstream side in the second direction and (b) a second pair of feed roller and its idler roller are provided in the vicinity of the recording medium and on the upstream side in the second direction, respectively, and the respective feed amount are detected by the feed amount detection means in accordance with the revolution of the feed roller or the idler roller of each pair.

In this case, the feed amount of the recording medium in the second direction is found by the calculations. During the feeding, the unevenness of the feeding force may occur due to how the recording medium is caught by the feed rollers and their idler rollers, thereby causing the bending of the recording medium.

In order to meet the deficiency, according to the present invention, in the respective first and second pairs that are provided in the vicinity of the recording medium and on the downstream and upstream sides in the second direction, the respective feed amount are detected in accordance with the revolution of the feed roller or the idler roller of each pair. This allows to detect that the unevenness of the feeding force have occurred. It is possible to detect the feed amount with higher accuracy based on the detected result.

It is preferable that, during the recording of the information corresponding to 1 line, a mark for detecting the feed amount is recorded in a non-record area of the recording medium, and the feed amount detection means detects the feed amount in the second direction based on the mark that has been recorded.

In this case, the feed amount of the recording medium is detected by the feed amount detection means based on the mark that has been recorded in the non-record area. This allows to detect the feed amount of the recording medium without affecting the recorded information in the record area and without any complicated structure. It is preferable that the recording of the mark is carried out with the use of a visualizing agent having a hue that is hard to be recognized. The recording of the mark may be made by the dot recording or the line recording. From a viewpoint of the quality of the recording, the dot recording is more preferable because the dot recording less damages the viewer's feeling and gives no ugly feeling to the viewer's.

It is preferable that the mark that has been recorded is detected by detection means provided on the more upstream side than the recording medium in the second direction. This allows to quickly cope with the recording operation in the next line.

It is preferable that the feed amount detection means is provided with (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

In this case, the idler roller rotates in accordance with the feed amount of the recording medium. In response thereto, the encoder rotates. The light from the light emitting section is emitted toward the encoder. When the light from the light emitting section is directed toward the slit, the light thus directed goes through the slit and arrives at the light receiving section. In contrast, when the light from the light emitting section is directed toward a part between the slits, the light thus directed is blocked and can not arrive at the light receiving section. This allows the light receiving section to generate pulse signals in accordance with the revolution of the idler roller. The number of revolution of the idler roller can be detected by counting the pulse number of the pulse signal. Since the circumference length of the idler roller is known, the feed amount of the recording medium that has been fed can be converted based on the number of revolution that has been thus detected.

It is preferable that the jet section selecting means is provided with (1) a first memory means for storing image information that has been read out from an original document, (2) a second memory means for storing record information that is a resultant of an image processing with respect to the image information that has been stored in the first memory means, and (3) a third memory means for storing a resultant, to be sent to the recording means, of removing the record information for maintaining a continuity between information that has been read out previously and information that will be read out next from the record information that has been recorded in the second memory means. The jet section selecting means (a) selects the jet sections in the third area so as to carry out an ordinary amount of recording when the feed amount of the recording medium is ordinary, (b) selects the jet sections in an area bridging between the second and third areas so as to carry out an ordinary amount of recording, then stores image information that has been read out from a broader area of the original document in the first through third memory means and selects all the jet sections in the third area and one part of the jet sections in the second area in accordance with the information that has been recorded in the third memory means for the recording of the recording means, when the feed amount of the recording medium is more than usual, and (c) selects the jet sections in an area bridging between the first and third areas so as to carry out an ordinary amount of recording, then stores information that has been read out from a narrower area of the original document in the first through third memory means and selects the jet sections on the first area side in the third area in accordance with the information that has been recorded in the third memory means for the recording of the recording means, when the feed amount of the recording medium is less than usual.

In this case, the original document is read out and the resultant image information is stored in the first memory means. The image information that has been stored in the first memory means is transmitted to the second memory means. The image information thus transmitted is subjected to the image processing, and the resultant of the image processing is stored as record information in the second memory means. The resultant of removing, the record information for maintaining the continuity between information that has been read out previously and information that will be read out next, from the record information that has been stored in the second memory means is stored in the third memory means. The information that has been stored in the third memory means is recorded on the recording medium via the recording means. Thus, the record information for maintaining the continuity between information that has been read out previously and information that will be read out next is remained in the second memory means, thereby ensuring to maintain the continuity of the information to be recorded on the recording medium.

When the feed amount of the recording medium is ordinary, all the jet sections in the third area are selected, the information that has been stored in the third memory means is transmitted to the recording means, and the ordinary amount of recording is carried out via the jet sections thus selected.

When the feed amount of the recording medium is more than usual, the jet sections in an area bridging between the second and third areas are selected so as to carry out the ordinary amount of recording. Then, the image information is read out from a broader area of the original document, and is stored in the first through third memory means in their respective forms. This causes the first through third memory means to have more amount of information than usual stored. All the jet sections in the third area and one part of the jet sections in the second area are selected in accordance with the information that has been recorded in the third memory means so that the recording means carry out the recording. This allows that all the jet sections in the third area are selected so as to carry out the next recording in an ordinary manner. Accordingly, it can be avoided that the excess of the feed amount is accumulated in the succeeding recordings.

When the feed amount of the recording medium is less than usual, the jet sections in an area bridging between the first and third areas are selected so as to carry out the ordinary amount of recording. Then, the image information is read out from a narrower area of the original document, and is stored in the first through third memory means in their respective forms. This causes the first through third memory means to have less amount of information than usual stored. The jet sections on the first area side in the third area in accordance with the information that has been recorded are selected in the third memory means so that the recording means carry out the recording. This allows that all the jet sections in the third area are selected so as to carry out the next recording in an ordinary manner. Accordingly, it can be avoided that the shortage of the feed amount is accumulated in the succeeding recordings.

As is clear from the foregoing description, even when the recording medium is fed more or less than usual, the continuity of the image information is maintained, the defect and overlapping of the image information do not occur, and it is possible to provide an apparatus with compact and low cost. Further, even when inadequate sheet feedings occur during the recording of a single recording medium, the inadequate sheet feedings are not accumulated, thereby ensuring to remarkably improve the quality of the recording.

The first through third memory means having a small recording capacity are used in considerations of such as (a) the size and cost of the apparatus and (b) the fact that the serial recording causes not to cover the large record area by a single scanning. According to the present invention, as has been described above, it is possible to effectively use such memory means having a small recording capacity.

There are described above novel features which the skilled man will appreciate give rise to advantages. These are each independent aspects of the invention to be covered by the present application, irrespective of whether or not they are included within the scope of the following claims.

What is claimed is:

1. A serial recording apparatus comprising at least one recording means for jetting visualizing agent toward a recording medium via a plurality of jet sections, in which information corresponding to 1 line is recorded on the recording medium while the recording medium is fed and scanned in a first direction, and feed means feeds the recording medium in a second direction, said apparatus further comprising:

feed amount detection means for detecting feed amount of the recording medium by the feed means in the second direction after each scanning finishes; and jet section selecting means for selecting jet sections to be used for recording among the plurality of jet sections in accordance with the feed amount that has been detected by the feed amount detection means.

2. The serial recording apparatus as set forth in claim 1, wherein the recording means includes:

a first area in which a plurality of jet sections are provided in a vicinity of an end part of the recording means on the upstream side in the second direction;

a second area in which a plurality of jet sections are provided in a vicinity of an end part of the recording means on the downstream side in the second direction; and a third area, other than the first and second areas in which a plurality of jet sections are provided, and the jet section selecting means (a) selects all the jet sections in the third area when the recording medium is fed by ordinary feed amount in the second direction, (b) selects the jet sections among the first through third areas in accordance with the feed amount that has been detected, when the recording medium is fed more than the ordinary amount in the second direction, and (c) selects the jet sections among the second and third areas in accordance with the feed amount that has been detected, when the recording medium is fed less than the ordinary amount in the second direction.

3. The serial recording apparatus as set forth in claim 2, wherein the number of the jet sections in each of the first and second areas is 10 percent of that in the third area.

4. The serial recording apparatus as set forth in claim 3, wherein the feed means includes a feed roller and its idler roller, and the feed amount detection means detects the feed amount in accordance with the amount of revolution of the feed roller or the idler roller.

5. The serial recording apparatus as set forth in claim 4, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

6. The serial recording apparatus as set forth in claim 3, wherein the feed means includes pairs of a feed roller and its idler roller, (a) a first pair of feed roller and its idler roller are provided in a vicinity of the recording medium and on the downstream side in the second direction and (b) a second pair of feed roller and its idler roller are provided in a vicinity of the recording medium and on the upstream side in the second direction, respectively, and the respective feed amount are detected by the feed amount detection means in accordance with the revolution of the feed roller or the idler roller of the each pair.

7. The serial recording apparatus as set forth in claim 6, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

8. The serial recording apparatus as set forth in claim 3, wherein, during recording of the information corresponding to 1 line, a mark for detecting the feed amount is recorded in a non-record area of the recording medium, and the feed amount detection means detects the feed amount of the recording medium in the second direction based on the mark that has been recorded.

9. The serial recording apparatus as set forth in claim 2, wherein the feed means includes a feed roller and its idler roller, and the feed amount detection means detects the feed amount in accordance with the amount of revolution of the feed roller or the idler roller.

10. The serial recording apparatus as set forth in claim 9, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

11. The serial recording apparatus as set forth in claim 2, wherein the feed means includes pairs of a feed roller and its idler roller, (a) a first pair of feed roller and its idler roller are provided in a vicinity of the recording medium and on the downstream side in the second direction and (b) a second pair of feed roller and its idler roller are provided in a vicinity of the recording medium and on the upstream side in the second direction, respectively, and the respective feed amount are detected by the feed amount detection means in accordance with the revolution of the feed roller or the idler roller of the each pair.

12. The serial recording apparatus as set forth in claim 11, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

13. The serial recording apparatus as set forth in claim 2, wherein, during recording of the information corresponding to 1 line, a mark for detecting the feed amount is recorded in a non-record area of the recording medium, and the feed amount detection means detects the feed amount of the recording medium in the second direction based on the mark that has been recorded.

14. The serial recording apparatus as set forth in claim 2, wherein the the jet section selecting means includes:

a first memory means for storing image information that has been read out from an original document, a second memory means for storing record information that is a resultant of an image processing with respect to the image information that has been stored in the first memory means, and a third memory means for storing a resultant, to be sent to the recording means, of removing the record information for maintaining a continuity between information that has been read out previously and information that will be read out next from the record information that has been recorded in the second memory means, wherein the jet section selecting means (a) selects the jet sections in the third area so as to carry out an ordinary amount of recording when the feed amount of the recording medium is ordinary, (b) selects the jet sections in an area bridging between the second and third areas so as to carry out an ordinary amount of recording, then stores image information that has been read out from a broader area of the original document in the first through third memory means and selects all the jet sections in the third area and one part of the jet sections in the second area in accordance with the information that has been recorded in the third memory means for the recording of the recording means, when the feed amount of the recording medium is more than usual, and (c) selects the jet sections in an area bridging between the first and third areas so as to carry out an ordinary amount of recording, then stores information that has been read out from a narrower area of the original document in the first through third memory means and selects the jet sections on the first area side in the third area in accordance with the information that has been recorded in the third memory means for the recording of the recording means, when the feed amount of the recording medium is less than usual.

15. The serial recording apparatus as set forth in claim 1, wherein the jet section selecting means (a) increases the number of the jet sections selected in the second area in accordance with the excess of feed amount while the jet sections selected in areas other than the second area are fixed, when the recording medium is fed more than the ordinary amount in the second direction, and (b) reduces the number of the jet sections selected in the third area in accordance with the shortage of feed amount while the jet sections selected in areas other than the third area are fixed (not changed), when the recording medium is fed less than the ordinary amount in the second direction.

16. The serial recording apparatus as set forth in claim 15, wherein the number of the jet sections in each of the first and second areas is 10 percent of that in the third area.

17. The serial recording apparatus as set forth in claim 16, wherein the feed means includes a feed roller and its idler roller, and the feed amount detection means detects the feed amount in accordance with the amount of revolution of the feed roller or the idler roller.

18. The serial recording apparatus as set forth in claim 17, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

19. The serial recording apparatus as set forth in claim 16, wherein the feed means includes pairs of a feed roller and its idler roller, (a) a first pair of feed roller and its idler roller are provided in a vicinity of the recording medium and on the downstream side in the second direction and (b) a second pair of feed roller and its idler roller are provided in a vicinity of the recording medium and on the upstream side in the second direction, respectively, and the respective feed amount are detected by the feed amount detection means in accordance with the revolution of the feed roller or the idler roller of the each pair.

20. The serial recording apparatus as set forth in claim 19, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

21. The serial recording apparatus as set forth in claim 16, wherein, during recording of the information corresponding to 1 line, a mark for detecting the feed amount is recorded in a non-record area of the recording medium, and the feed amount detection means detects the feed amount of the recording medium in the second direction based on the mark that has been recorded.

22. The serial recording apparatus as set forth in claim 15, wherein the feed means includes a feed roller and its idler roller, and the feed amount detection means detects the feed amount in accordance with the amount of revolution of the feed roller or the idler roller.

23. The serial recording apparatus as set forth in claim 22, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

24. The serial recording apparatus as set forth in claim 15, wherein the feed means includes pairs of a feed roller and its idler roller, (a) a first pair of feed roller and its idler roller are provided in a vicinity of the recording medium and on the downstream side in the second direction and (b) a second pair of feed roller and its idler roller are provided in a vicinity of the recording medium and on the upstream side in the second direction, respectively, and the respective feed amount are detected by the feed amount detection means in accordance with the revolution of the feed roller or the idler roller of the each pair.

25. The serial recording apparatus as set forth in claim 24, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

26. The serial recording apparatus as set forth in claim 15, wherein, during recording of the information corresponding to 1 line, a mark for detecting the feed amount is recorded in a non-record area of the recording medium, and the feed amount detection means detects the feed amount of the recording medium in the second direction based on the mark that has been recorded.

27. The serial recording apparatus as set forth in claim 1, wherein the feed means includes a feed roller and its idler roller, and the feed amount detection means detects the feed amount in accordance with the amount of revolution of the feed roller or the idler roller.

28. The serial recording apparatus as set forth in claim 27, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

29. The serial recording apparatus as set forth in claim 1, wherein the feed means includes pairs of a feed roller and its idler roller, (a) a first pair of feed roller and its idler roller are provided in a vicinity of the recording medium and on the downstream side in the second direction and (b) a second pair of feed roller and its idler roller are provided in a vicinity of the recording medium and on the upstream side in the second direction, respectively, and the respective feed amount are detected by the feed amount detection means in accordance with the revolution of the feed roller or the idler roller of the each pair.

30. The serial recording apparatus as set forth in claim 29, wherein the feed amount detection means includes: (a) an encoder made of a rotor, having slits provided at equal spaces in its periphery, that rotates in accordance with the revolution of the idler roller, and (b) light emitting section and light receiving section that are provided so as to be opposite to each other via the encoder in the vicinity of the periphery.

31. The serial recording apparatus as set forth in claim 1, wherein, during recording of the information corresponding to 1 line, a mark for detecting the feed amount is recorded in a non-record area of the recording medium, and the feed amount detection means detects the feed amount of the recording medium in the second direction based on the mark that has been recorded.

* * * * *